US005820334A

United States Patent [19]

Darcy et al.

[11] Patent Number: 5,820,334

[45] Date of Patent: Oct. 13, 1998

[54] PAPER SET FEEDING

[75] Inventors: James A. Darcy, Windham; Thomas E. Weeks, Manchester, both of N.H.

[73] Assignee: Standard Duplicating Machines Corporation, Andover, Mass.

[21] Appl. No.: 587,636

[22] Filed: Jan. 17, 1996

Related U.S. Application Data

[62] Division of Ser. No. 486,931, Jun. 7, 1995, Pat. No. 5,556, 254.

[51] Int. Cl.[6] ..... B65G 59/06

[52] U.S. Cl. ..... 414/798.1; 414/796.1; 414/796.4; 414/797.7; 414/798; 414/786

[58] Field of Search ..... 414/786, 796.1, 414/796.2, 796.3, 796.4, 797.7, 798, 798.1; 271/121, 131, 137, 138

[56] References Cited

U.S. PATENT DOCUMENTS

| | | | |
|---|---|---|---|
| 820,804 | 5/1906 | Lucy | 414/795.5 |
| 1,158,045 | 10/1915 | Graham . | |
| 2,936,909 | 5/1960 | Gard | 214/8.5 |
| 3,095,193 | 6/1963 | Sorenson | 271/42 |
| 3,190,642 | 6/1965 | Smith | 271/42 |
| 3,206,042 | 9/1965 | Peterson | 214/8.5 |
| 3,640,426 | 2/1972 | Hammer | 221/67 |
| 3,661,278 | 5/1972 | Hammerle | 214/8.5 |
| 3,690,476 | 9/1972 | Stacy | 414/796.1 |
| 3,726,168 | 4/1973 | Glanz et al. | 271/131 |
| 3,815,762 | 6/1974 | Hoke et al. | 414/796 |
| 3,960,291 | 6/1976 | Navi | 221/36 |
| 3,995,092 | 11/1976 | Hubert | 214/8.5 |
| 3,997,067 | 12/1976 | Murata | 214/8.5 |
| 4,046,370 | 9/1977 | Navi | 271/3.1 |
| 4,079,846 | 3/1978 | Tsuruta . | |
| 4,119,219 | 10/1978 | Marschke | 214/8.5 |
| 4,247,093 | 1/1981 | Kistner et al. | 414/796 |
| 4,396,336 | 8/1983 | Malamood | 414/115 |
| 4,405,276 | 9/1983 | Wiegand | 414/119 |
| 4,547,115 | 10/1985 | Charbonnet | 414/121 |
| 4,667,948 | 5/1987 | Angelbeck et al. | 271/98 |
| 4,696,615 | 9/1987 | Ettischer et al. | 414/796.8 |
| 4,699,371 | 10/1987 | Ettischer et al. | 414/797.4 |
| 4,701,094 | 10/1987 | Courjaret et al. | 271/137 |
| 4,718,808 | 1/1988 | Hoshino et al. | 271/138 |
| 4,718,809 | 1/1988 | Krasuski et al. | 414/797.4 |
| 4,783,064 | 11/1988 | Hayashi | 271/131 |
| 4,907,942 | 3/1990 | Pfeil | 414/798 |
| 4,955,784 | 9/1990 | Staszewski et al. | 414/796.4 |
| 4,966,521 | 10/1990 | Frye et al. | 414/796.1 |
| 4,988,263 | 1/1991 | Odenthal | 414/795.8 |
| 5,011,126 | 4/1991 | Suzuki et al. | 271/227 |
| 5,018,940 | 5/1991 | Hognestad et al. | 414/796.8 |
| 5,026,250 | 6/1991 | Hofer | 414/796.1 |
| 5,067,702 | 11/1991 | Muraishi et al. | 271/137 |
| 5,096,367 | 3/1992 | Winski | 414/798.1 |
| 5,096,370 | 3/1992 | Mohr | 414/795.5 |
| 5,096,372 | 3/1992 | Maejima | 414/796.7 |
| 5,102,293 | 4/1992 | Schneider | 414/796 |
| 5,207,416 | 5/1993 | Soler | 271/31 |
| 5,244,340 | 9/1993 | Pizzi et al. | 414/796.9 |
| 5,261,667 | 11/1993 | Breeding | 273/149 |
| 5,380,147 | 1/1995 | Hess et al. | 414/796 |
| 5,417,543 | 5/1995 | Focke et al. | 414/796.9 |

FOREIGN PATENT DOCUMENTS

| | | | |
|---|---|---|---|
| 3443735 | 8/1986 | Germany | 271/131 |
| 81832 | 3/1990 | Japan | 271/105 |
| 749777 | 7/1980 | U.S.S.R. | 271/131 |
| 1039435 | 8/1966 | United Kingdom | 414/796.1 |

*Primary Examiner*—Karen B. Merritt
*Assistant Examiner*—Douglas Hess
*Attorney, Agent, or Firm*—Fish & Richardson P.C.

[57] ABSTRACT

In a sheet set feeder, a shutter mechanism disposed at least in part beneath a hopper for receiving a stack of offset-jogged sheet sets defines an aperture sized to admit individual sets from the stack. The shutter mechanism is driven so that the aperture is moved from beneath one end of the bottommost sheet set—where a retainer supports the next-to-bottommost sheet set—to beneath the other end of the bottommost set. Individual sets fed by the feeder are then carried by a conveyor to a sheet set processor.

26 Claims, 26 Drawing Sheets

PAPER SET FEEDING

This is a divisional of application Ser. No. 08/486,931, filed Jun. 7, 1995 now U.S. Pat. No. 5,556,255.

BACKGROUND OF THE INVENTION

The invention relates to feeding offset-jogged sets of sheets.

Many devices for printing and/or processing sheets of paper, such as laser or other electronic printers, offset printers, photocopiers, and collating equipment, can be operated to produce plural "sheet sets," e.g., where each set of sheets is one copy of a multiple-page document. Successive sheet sets in the "stack" of sets are typically "offset-jogged" with respect to one another. That is, each individual set is shifted or offset—either laterally, longitudinally, or radially—with respect to the immediately adjacent set or sets.

After being printed and/or collated, individual sheet sets are often processed, such as by covering, trimming, folding, stitching, or otherwise binding them. Such processing can occur either "on-line" or "off-line." In on-line processing, individual sheet sets are removed and transported to the processor as they are outputted from the printer or collator.

In off-line processing, the entire stack of sheet sets is transferred to the processor or processors after printing or collating is complete. The processor then identifies and processes individual sheet sets. Because processing equipment typically has a higher "throughput rate" (i.e., sheets per unit time) than printers or collators, the outputs of several printers and/or collators may be fed to a single processing unit.

SUMMARY OF THE INVENTION

In one aspect of the invention, a shutter mechanism disposed beneath a hopper for a stack of offset-jogged sheet sets defines an aperture sized to admit individual sets from the stack. The shutter mechanism is driven so that the aperture moves from beneath one end of the bottommost sheet set—where a retainer supports the next-to-bottommost sheet set—to beneath the other end of the bottommost set.

Another aspect of the invention is a method for feeding individual sets from a stack of offset-jogged sheet sets in a hopper. A shutter beneath the hopper is moved so that an aperture defined by the shutter moves from beneath one end of the bottommost sheet set to beneath the other end of the set.

Among other advantages, the invention—which can be linked to the outputs of existing printing, copying, and/or collating equipment that produces offset-jogged sets—can be used to separate an individual sheet set as a whole from a stack of such sets for further processing, such as covering, trimming, or binding. Because it manipulates entire sheet sets, the invention can process a greater number of sheets per unit time than a device cycling at the same speed that manipulates every sheet within each set. Conversely, the invention can achieve the same overall sheet throughput rate as such a single-sheet manipulator while operating at lower cyclical speeds, thus reducing the likelihood of jamming and both the magnitude and rate of wear.

The invention achieves these advantages by capitalizing on the offset-jogged nature of the stack of sheet sets. It is thus not necessary to, e.g., mark individual sheet sets, such as with bar codes or other optically readable markings that might remain on the final document and detract from its overall appearance. Nor is it necessary to, e.g., reformat or modify in any way the output from the printer or collator, such as by segregating individual sheet sets with physical markers, such as slip sheets or chip boards interleaved between adjacent sets. Because such markers need not be added to the stack as the sets are generated or separated out from the individual, separated sheet sets prior to processing, the overall complexity of the set-separating operation is reduced.

Moreover, the invention can be used to separate sheet sets automatically, reducing or eliminating entirely the amount of human operator involvement necessary to process stacks of sets.

Preferred embodiments of the invention include the following features.

In a particularly useful embodiment, a sheet set conveyor (e.g., a rotator or a conveyor belt) is disposed beneath the aperture, and a door is disposed between the conveyor and the aperture. The door serves as a buffer to hold an individual sheet set after it passes through the aperture, and opens quickly to drop the set onto the conveyor below. The shutter defining the aperture includes a series of rollers extending, e.g., between flexible drive members such as link chains or the sides of a rigid planar frame. A sheet of urethane on a tensioning bar biased towards the rollers contacts at least some of the rollers, causing the rollers to spin as the aperture is moved with respect to the hopper by, e.g., a reversible motor or a linear actuator.

Like the retainer supporting the next-to-bottommost sheet set, another retainer supports the bottommost sheet set. The retainers comprise shelves that extend from opposed sides of the hopper a distance approximately equal to the distance between the offset-jogged ends of the bottommost and next-to-bottommost sheet sets. The shelves are pivotally (or alternatively, slidably) mounted to the feeder housing, and include sheets of urethane located to contact the next-to-bottommost and bottommost sheet sets. The separation of adjacent sheet sets in the hopper is facilitated by wedges at the edges of the aperture, as well as by air jet passages in either the shelves or the wedges that provide timed air jet blasts.

In another useful embodiment, the retainer for supporting the next-to-bottommost set comprises a portion of the shutter disposed adjacent the aperture. The aperture is defined by opposed edges of two shutter portions that can be moved with respect to one another.

In another aspect of the invention, a sheet set processing system includes an offset-jogged sheet set feeder, a sheet set processor, and a mechanical conveyor that conveys sets from the feeder to the processor.

Among other advantages in addition to those identified above, the processing system can be used to automatically separate and process individual sheet sets from a stack of such sets loaded into the feeder.

In a particularly useful embodiment, the system includes a cover feeder, and the sheet set processor comprises one or more of the following: a stitcher, a folder, a face trimmer, a perfect binder, a mailing/inserting system, a shrink wrapper, or a collator.

Other advantages and features will become apparent from the following description of the preferred embodiments and from the claims.

DESCRIPTION OF PREFERRED EMBODIMENTS

Figure 1:
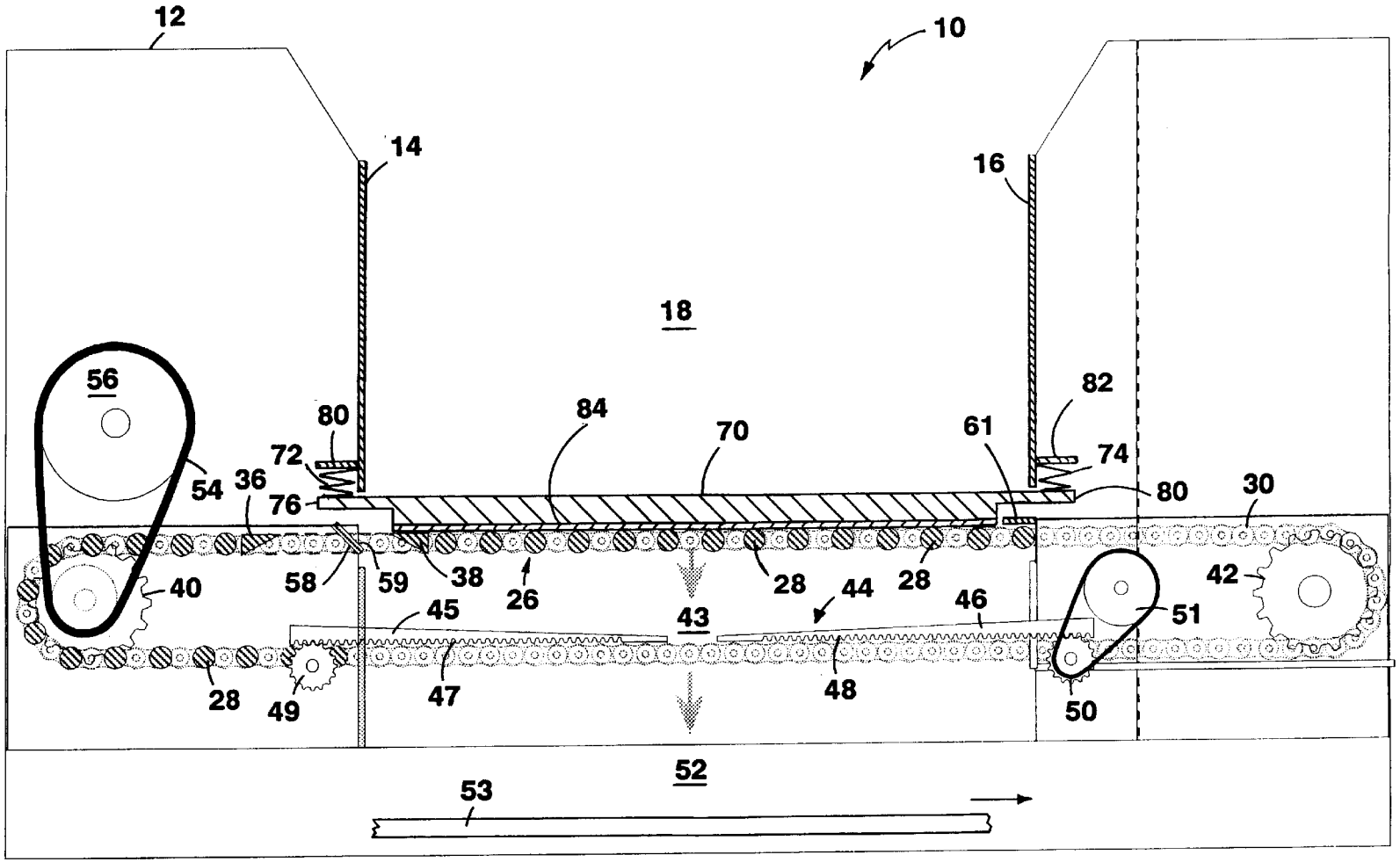
FIG. 1 is a cross-sectional side view of a sheet set feeder.
Figure 2:
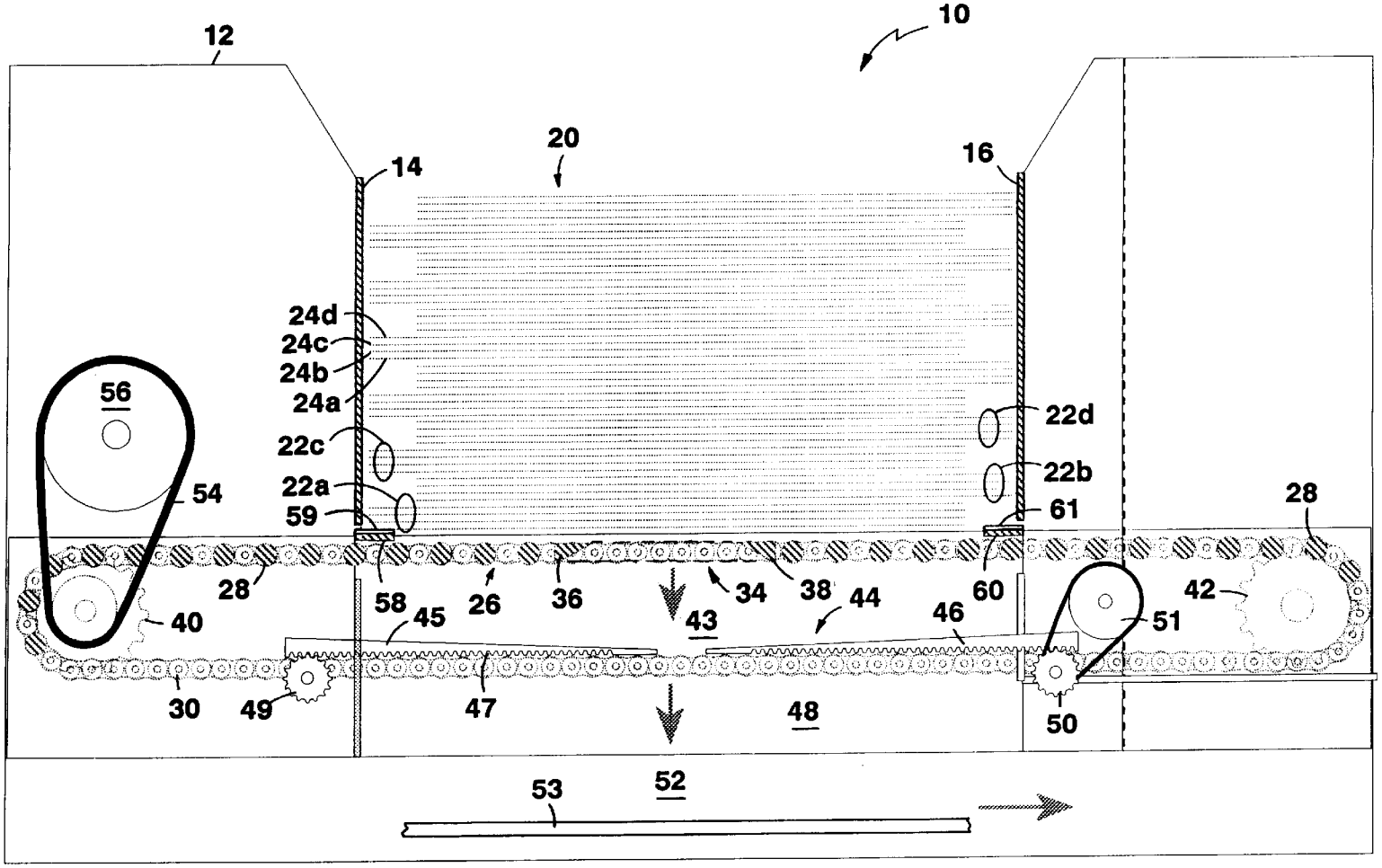
FIG. 2 is a cross-sectional side view of the sheet set feeder shown in FIG. 1, with a stack of sheet sets placed into the feeder.
Figure 3:
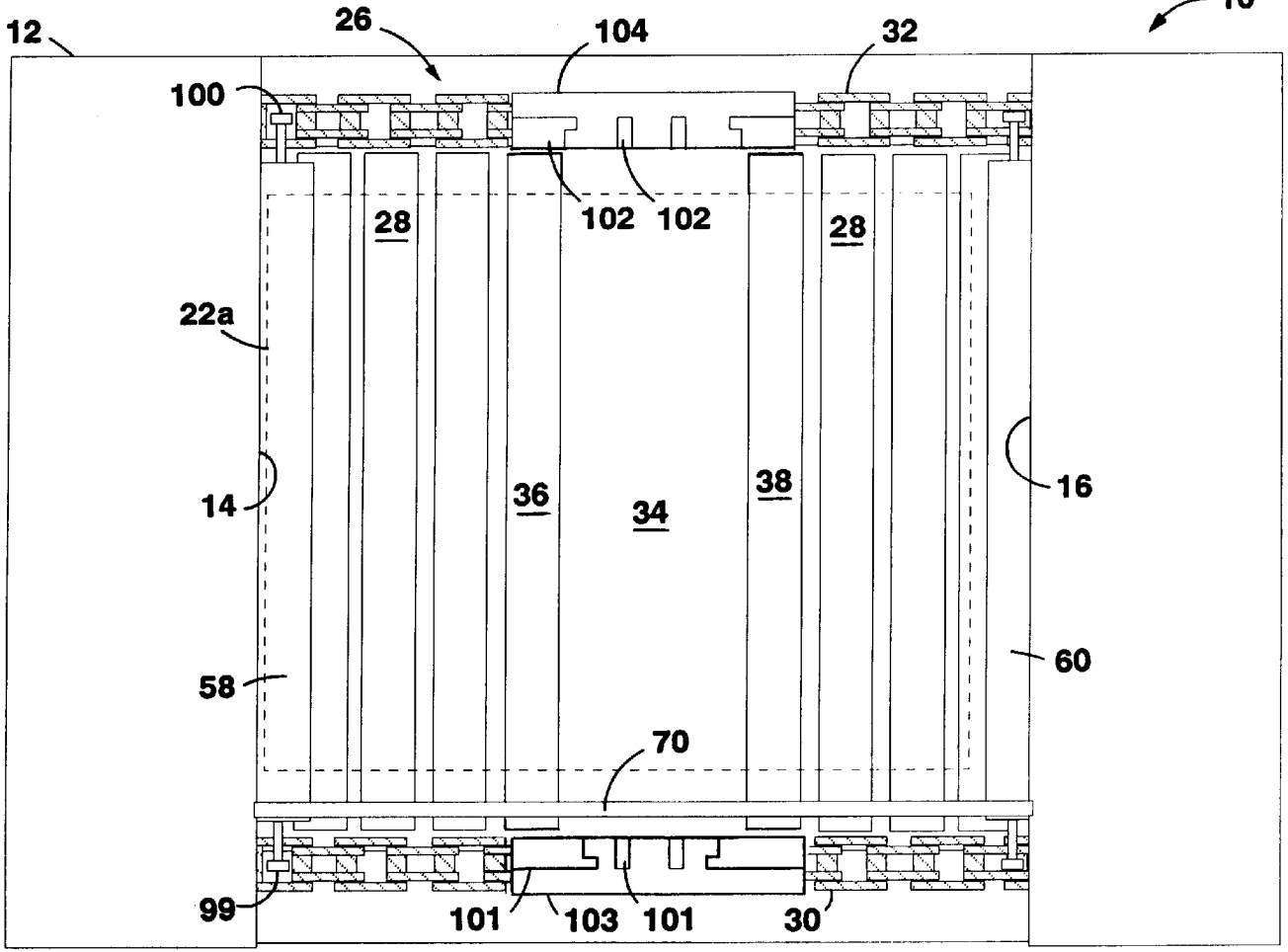
FIG. 3 is a top view of the sheet set feeder shown in FIG. 1.

As shown in FIGS. 1, 2, and 3, a sheet set feeder 10 includes a housing 12. Two facing vertical walls of housing 12, left wall 14 and right wall 16, define a hopper 18 for receiving a stack 20 comprised of offset-jogged sheet sets 22*a*, 22*b*, 22*c*, 22*d*, each of which in turn comprises two or more sheets 24*a*, 24*b*, 24*c*, 24*d* of, e.g., paper. (Sheet set feeder 10 can also be used to feed offset-jogged sets of other types of substantially planar sheets, such as of film or fabric.) The distance between left wall 14 and right wall 16 of hopper 18 is approximately equal to the length of a single sheet set, plus the distance by which each set is offset-jogged with respect to adjacent sets. Right wall 16 can be moved toward and away from left wall 14 to adjust the dimensions of hopper 18 to accommodate sets of different lengths.

A shutter 26 disposed beneath hopper 18 supports stack 20. Shutter 26 comprises a series of support rollers 28 disposed between a pair of link chains 30, 32. Rollers 28 are spaced at regular intervals along chains 30, 32, except for one region intermediate the ends of shutter 26 in which the rollers are separated to define an aperture 34. A pair of wedges, left wedge 36 and right wedge 38, are attached, with their pointed ends directed toward one another, to opposite edges of aperture 34. Both the portion of shutter 26 that lies to the left of left wedge 36 and the portion of shutter 26 that lies to the right of right wedge 38 are approximately equal to the distance between left wall 14 and right wall 16 of hopper 18.

The width of aperture 34 (i.e., the distance between chains 30, 32) is selected based on the width of sets 22*a*, 22*b*, 22*c*, 22*d*. The length of aperture 34 (i.e., the distance between the opposed edges of wedges 36, 38) is selected based on, among other things, the thickness of sets 22*a*, 22*b*, 22*c*, 22*d*, the thickness of the individual sheets of paper 24*a*, 24*b*, 24*c*, 24*d* in each set, and the width and length dimensions of the sheets. In general, as the thicknesses of the sets and sheets increase, so also should the length of aperture 34. The length of aperture 34 can be adjusted by, e.g., replacing wedges 36, 38 with wedges of different lengths. Alternatively, the length of aperture 34 could be adjusted automatically based on the dimensions of the sets and sheets placed into hopper 18. It has been found that an aperture length of about 4 in. (10.16 cm.) yields acceptable performance when feeding sets of standard 20 pound, 8½×11 in. (21.6×27.9 cm.) sheets of paper, where the sets are between 2 sheets and 1 in. (2.54 cm., about 250 sheets) thick.

Shutter 26, and thus also aperture 34, are reciprocatingly shuttled back and forth with respect to hopper 18 by the action of chains 30, 32. Other flexible drive members, such as belts, bands, or cables, could be used instead of chains 30, 32. Chains 30, 32 are continuous-loop chains that mesh with a pair of sprockets 40, 42 rotatably attached to housing 12. (Only those sprockets that mesh with chain 30 are shown. The sprockets that mesh with chain 32 are arranged in an identical fashion.) One of these sprockets, sprocket 40, is driven through a continuous-loop belt 54 by a reversible electric motor 56. Reversing the direction of rotation of motor 56 reverses also the direction of motion of aperture 34 with respect to hopper 18. In addition, the rotational speed of motor 56 may be controlled to vary the linear speed of chains 30, 32 and aperture 34.

A door 44 is disposed directly beneath shutter 26, such that the space between door 44 and shutter 26 defines a primary set accumulator 43. Door 44 is comprised of left and right door halves 45, 46. A rack 47, 48 attached beneath each door half 45, 46 mates with a pinion gear 49, 50 driven by a respective motor 51 (only the motor 51 that drives right pinion gear 50 is shown). Alternatively, a single motor can be used to drive both pinion gears. Motor 51 is a high-speed reversible electric motor, and the gear train is selected so that door halves 45, 46 open quickly when motor 51 is energized.

A secondary set accumulator 52 is disposed beneath door 44. Secondary set accumulator 52 can include a conveyor belt 53 for carrying away individual sets 22*a*, 22*b*, 22*c*, 22*d* as they drop down from primary accumulator 43, and/or a rotator 540 (FIGS. 17, 18, 19) for rotating the individual sets, e.g., by 90°.

Sheet set feeder 10 further includes a pair of shelves, left shelf 58 and right shelf 60, pivotally attached to housing 12. When they are horizontal, shelves 58, 60 extend away from walls 14, 16 a distance approximately equal to the distance between the ends of adjacent offset-jogged sheet sets 22*a*, 22*b*, 22*c*, 22*d*. Thus, left shelf 58 extends far enough into hopper 18 to support the left edge of sheet set 22*a*, but not far enough to support the left edge of sheet set 22*b*. Similarly, right shelf 60 extends far enough into hopper 18 to support the right edge of sheet set 22*b*, but not far enough to support the right edge of sheet set 22*a*. Sheets of urethane 59, 61 on the top surfaces of left and right shelves 58, 60 prevent the sets 22*a*, 22*b*, 22*c*, 22*d* from slipping off the shelves as shutter 26 moves back and forth.

When aperture 34 shuttles toward and past left wall 14 of hopper 18, left shelf 58 rotates clockwise to the near-vertical orientation shown in FIG. 1. When aperture 34 shuttles back toward right wall 16, left shelf 58 rotates counter-clockwise to its original, horizontal orientation, as shown in FIG. 2. Similarly, when aperture 34 shuttles past right wall 16 of hopper 18, right shelf 58 rotates counter-clockwise to a near-vertical orientation, and rotates clockwise back to its horizontal orientation when aperture 34 shuttles back toward left wall 14.

Figure 4A:
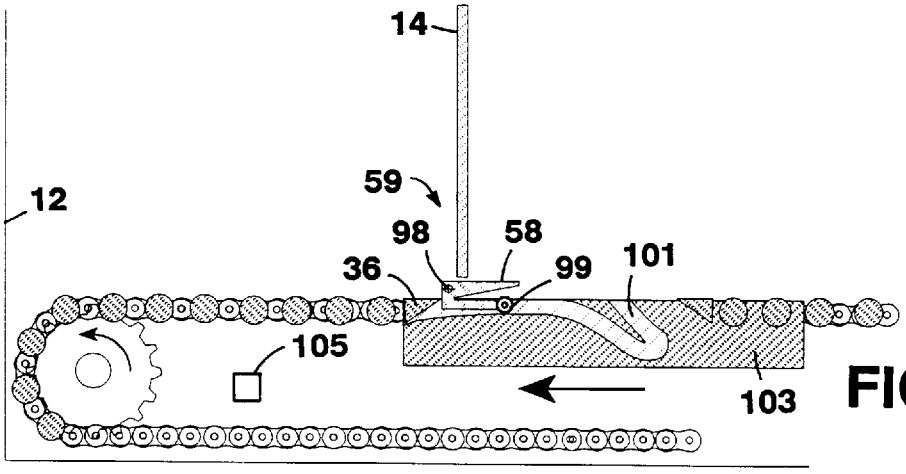
FIGS. 4A, 4B, and 4C are cross-sectional side views of a mechanism for actuating a shelf of the sheet set feeder shown in FIG. 1.
Figure 4B:
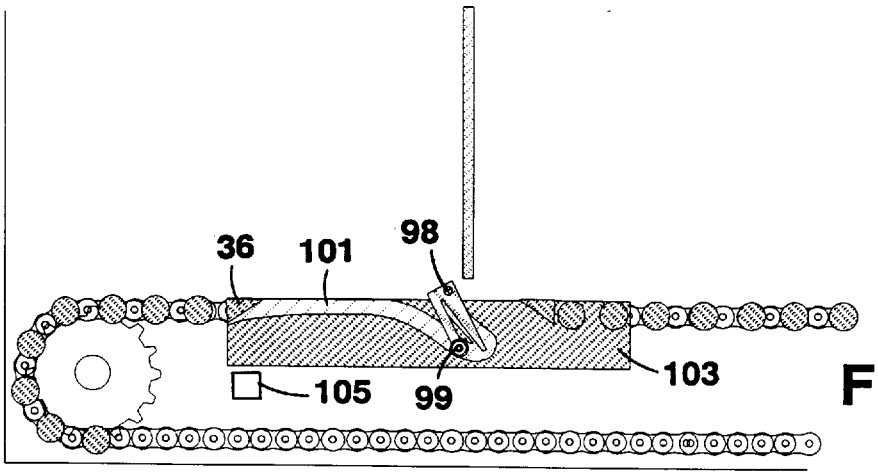
Figure 4C:
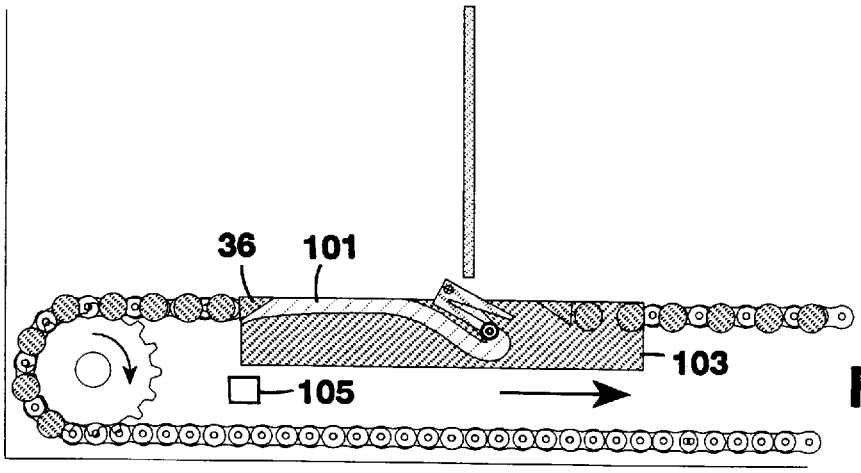

The mechanism 59 for actuating left shelf 58 is shown in detail in FIGS. 4A, 4B, and 4C. The mechanism for actuating right shelf 60 is identical in all material respects to mechanism 59. Left shelf 58 is attached to housing 12 by a pin hinge/torsion spring.98, which allows shelf 58 to rotate, and also biases it in a counterclockwise direction against left wall 14. Cam followers 99, 100 are rotatably attached to either end of left shelf 58 (see also FIG. 3). When left wedge 36 of aperture 34 moves to the left past left wall 14, cam followers 99, 100 engage channels 101, 102 in respective channel box cams 103, 104 located at the sides of aperture 34. Channels 101, 102 are shaped so that, as left wedge 36 continues to move to the left, left shelf 58 rotates clockwise to a near-vertical orientation, as shown in FIG. 4B. At this point, the left edge of channel box cam 103 passes a proximity switch 105, which reverses the direction of rotation of motor 56, and thus also the direction of movement of aperture 34. Channels 101, 102 are shaped so that, as channel box cams 103, 104 move to the right, left shelf 58 rotates counterclockwise back up to its original, horizontal, orientation.

As shown in FIGS. 1 and 3, sheet set feeder 10 further includes a tensioning bar 70 that extends across hopper 18 between left wall 14 and right wall 16. (For clarity, tensioning bar 70 is not shown in FIG. 2.) Tensioning bar 70 is located between the edge of shutter 26 and the edge of stack 20 (set 22*a* is shown in phantom in FIG. 3), so as not to interfere with the motion of sets 22*a*, 22*b*, 22*c*, 22*d* as they pass through aperture 34. Springs 72, 74 are disposed between the ends 76, 78 of tensioning bar 70 and fingers 80, 82 projecting horizontally from the inside surfaces of walls 14, 16, biasing bar 70 downward toward shutter 26. A sheet of urethane 84 on the bottom surface of tensioning bar 70 contacts rollers 28 of shutter 26.

Figure 5:
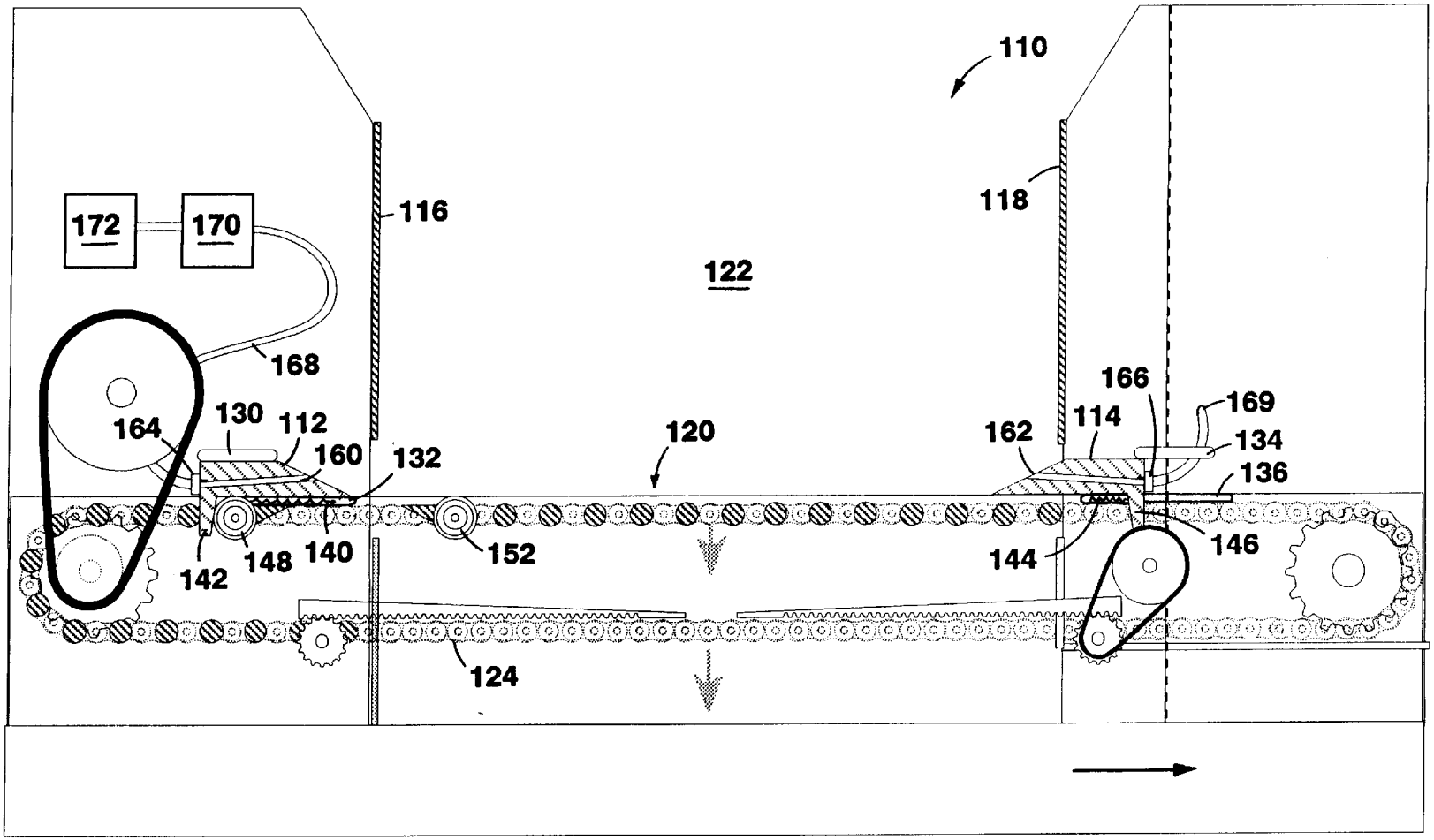
FIG. 5 is a cross-sectional side view of another sheet set feeder.
Figure 6:
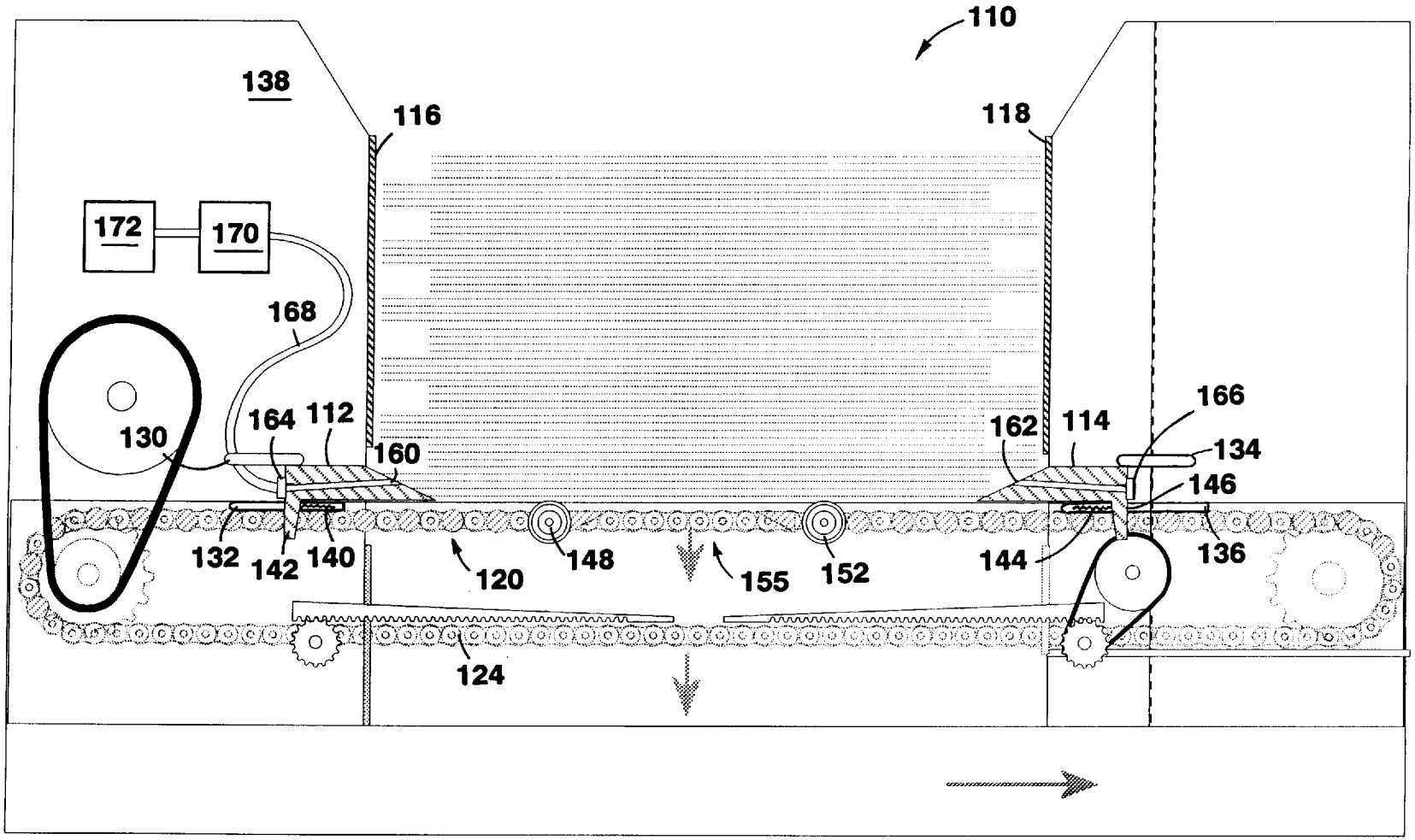
FIG. 6 is a cross-sectional side view of the sheet set feeder shown in FIG. 5, with a stack of sheet sets placed into the feeder.
Figure 7:
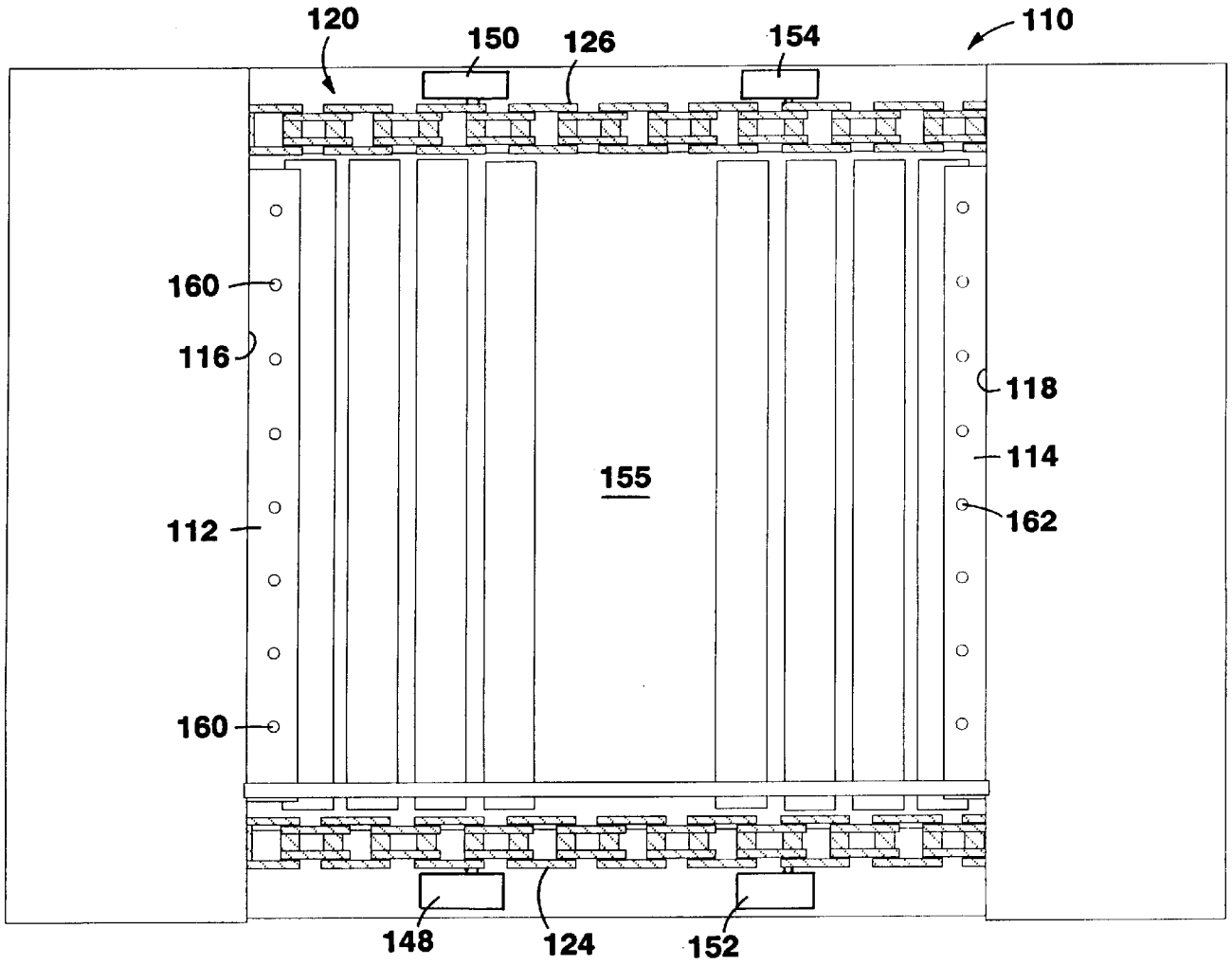
FIG. 7 is a top view of the sheet set feeder shown in FIG. 5.

Another sheet set feeder 110 is shown in FIGS. 5, 6, and 7. Sheet set feeder 110 is identical in many respects to sheet set feeder 10, except, whereas shelves 58, 60 in feeder 10 pivot, the shelves 112, 114 in feeder 110 retract into the left and right walls 116, 118 of the feeder. As in feeder 10, walls 116, 118, together with a shutter 120, define the hopper 122 of feeder 110, and drive chains 124, 126 move shutter 120 with respect to hopper 122.

Shelves 112, 114 are slidably disposed between spaced-apart brackets 130, 132, 134, 136 attached to the housing 138 of feeder 110. A spring 140 attached between bracket 122 and a finger 142 projecting down from shelf 112 biases shelf 112 toward shelf 114, and a spring 144 attached between bracket 136 and a finger 146 projecting down from shelf 114 likewise biases shelf 114 toward shelf 116. Bearings 148, 150, 152, 154 are attached to drive chains 124, 126 near the corners of the aperture 155 in shutter 120. Thus, as shown in FIG. 5, when the left edge of aperture 155 moves past left wall 116, bearings 148, 150 engage the fingers 132 (only one finger 132 shown) projecting down from shelf 112, causing it to slide into left wall 116. Right shelf 114 behaves similarly when the right edge of aperture 155 moves past right wall 116.

Shelves 112, 114 are also provided with a number of air passages 160, 162 spaced at regular intervals along the lengths of the shelves. Air passages 160, 162 are angled slightly upwardly, and facilitate sheet separation during operation, as described in detail below. A manifold 164, 166 at the back of each shelf 112, 114 is in communication with all of the air passages in each shelf. A tube 168, 169 connects each manifold 164, 166 to a solenoid valve 170 (only tube 168 is shown connected to valve 170), which is in turn connected to a source of pressurized gas 172. When solenoid valve 170 is energized, high pressure air is supplied to manifolds 164, 166, causing high-velocity air jets to issue from air passages 160, 162.

Figure 8A:
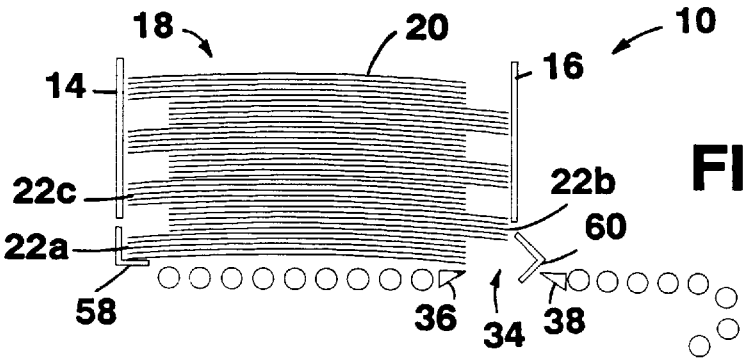
FIGS. 8A, 8B, 8C, and 8D are schematic side views showing the sheet set feeder shown in FIG. 1 in operation.
Figure 8B:
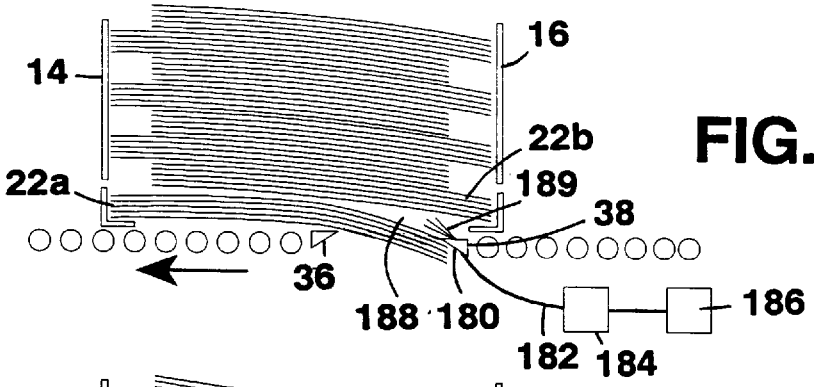

In operation, stack 20 is placed into hopper 18 of sheet set feeder 10 so that bottommost set 22*a* rests on rollers 28, as shown in FIG. 8A. (The operation of feeder 110 is similar to that of feeder 10.) The right edge of aperture 34 is initially past right wall 16 of hopper 18, and so left and right shelves 58, 60 are oriented horizontally and vertically, respectively. Motor 56 is then energized to cause aperture 34 to move to the left. When the left wedge 36 of aperture 34 moves past the right edge of bottommost set 22*a*, gravity causes the end of set 22*a* to droop through the aperture, as shown in FIG. 8B. And when right wedge 38 moves past right wall 16, right shelf 60 rotates clockwise back to its horizontal orientation, thereby preventing the right edge of next-to-bottommost set 22*b* from drooping through aperture 34.

Optionally, left and right wedges 36, 38 may each be provided with a manifold and a series of upwardly angled air passages, as in shelves 112, 114 of feeder 110. As shown in FIG. 8B, the passages 180 in right wedge 38 are supplied with air by a line 182 connected to a solenoid valve 184 and a source of pressurized air 186. When right wedge 38 moves to the left past right wall 16, solenoid 184 is activated and jets of air 189 issue from passages 180, further preventing next-to-bottommost set 22*b* from drooping through aperture 34 and facilitating the separation of set 22*a* from the bottom of stack 20.

Figure 8C:
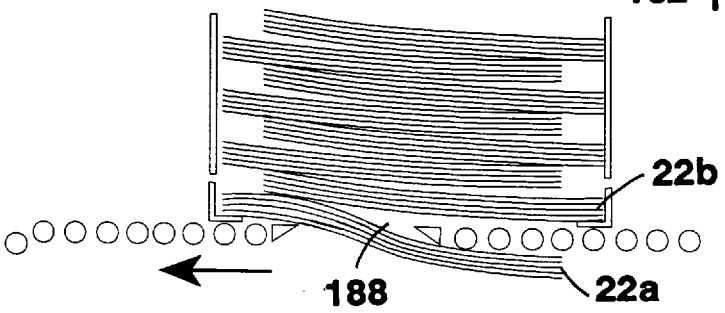
Figure 8D:
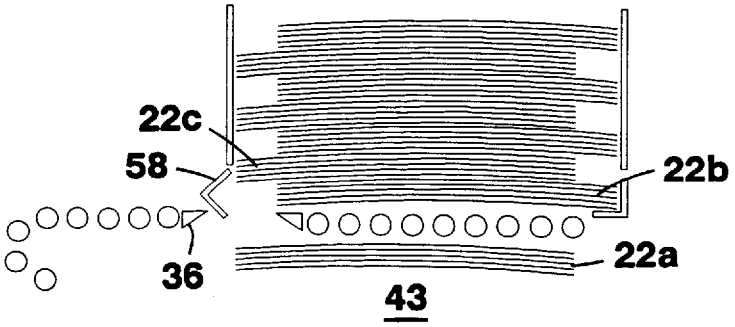

As aperture 34 continues to move to the left, left wedge 36 moves into the gap 188 between bottommost set 22*a* and next-to-bottommost set 22*b*, peeling off bottommost set 22*a* as shown in FIG. 8C. Urethane sheet 61 (FIGS. 1 and 2) on the top surface of right shelf 60 prevents set 22*b* from slipping to the left off shelf 60 as shutter 26 moves to the left. As shown in FIG. 8D, when left wedge 36 of aperture 34 moves past left wall 14 of hopper 18, left shelf 58 rotates clockwise to its vertical orientation, allowing set 22*a* to fall into primary set accumulator 43.

When aperture 34 reaches its leftmost extent of travel, motor 56 reverses direction, causing the aperture to shuttle back towards right wall 16 of hopper 18. Left shelf 58 rotates counterclockwise back to its original, horizontal orientation to support set 22*c* (which is now the next-to-bottom-most set), and left wedge 36 peels set 22*b* (which is now the bottommost set) from the bottom of stack 20. While set 22*b* is being peeled off the bottom of stack 20, door 44 at the bottom of primary set accumulator 43 (FIG. 1) is quickly opened to allow set 22*a* to fall onto conveyor belt 53. Door 44 and primary accumulator 43 thus act as a buffer between set feeder 10 and conveyor belt 53, serving to synchronize the relatively slow rate at which individual sets are peeled off with the relatively high speed of conveyor belt 53. If primary accumulator 43 is not used, the drooping end of bottommost set 22*a* might come into contact with moving conveyor belt 53 before the set is completely stripped off stack 20. Should this occur, the relatively quickly moving belt 53 might, e.g., pull individual sheets 24*a*, 24*b*, 24*c*, 24*d* entirely or partially out of set 22*a*. If conveyor belt operates relatively slowly, primary accumulator 43 and door 44 may not be needed.

When right wedge 38 of aperture 34 moves past right wall 16 of hopper 18, right shelf 60 again rotates to the vertical orientation shown in FIG. 8A, allowing set 22*b* to fall into primary set accumulator 43. The cycle repeats until all remaining sets 22*c*, 22*d* are fed into primary set accumulator 43, and from there onto conveyor belt 53.

To provide for smooth motion of reciprocating shutter 26 throughout each cycle, motor 56 is initially controlled so that it ramps up from zero velocity to a constant speed. This speed is maintained until shutter 26 nears its leftmost or rightmost point of travel, at which point the motor speed is ramped back down to zero. The direction of rotation of motor 56 is then reversed, and the velocity profile repeated for the next cycle.

When stack 20 consists of a number of sets, the weight of the sets is generally sufficient to cause rollers 28 to roll freely as shutter 26 shuttles back and forth. However, when stack 20 consists of only a few sets, the weight of the sets alone may in some circumstances be insufficient to cause rollers 28 to roll. If so, as it shuttles back and forth shutter 26 may move the entire stack laterally against left and right walls 14, 16, which can "de-jog" the sets (i.e., reduce or eliminate the offset between the ends of adjacent sets). By pressing against rollers 28 with a constant force (as determined by springs 72, 74), tensioning bar 70 causes the rollers to roll irrespective of the weight of stack 20, preventing or reducing this de-jogging effect.

Figure 9:
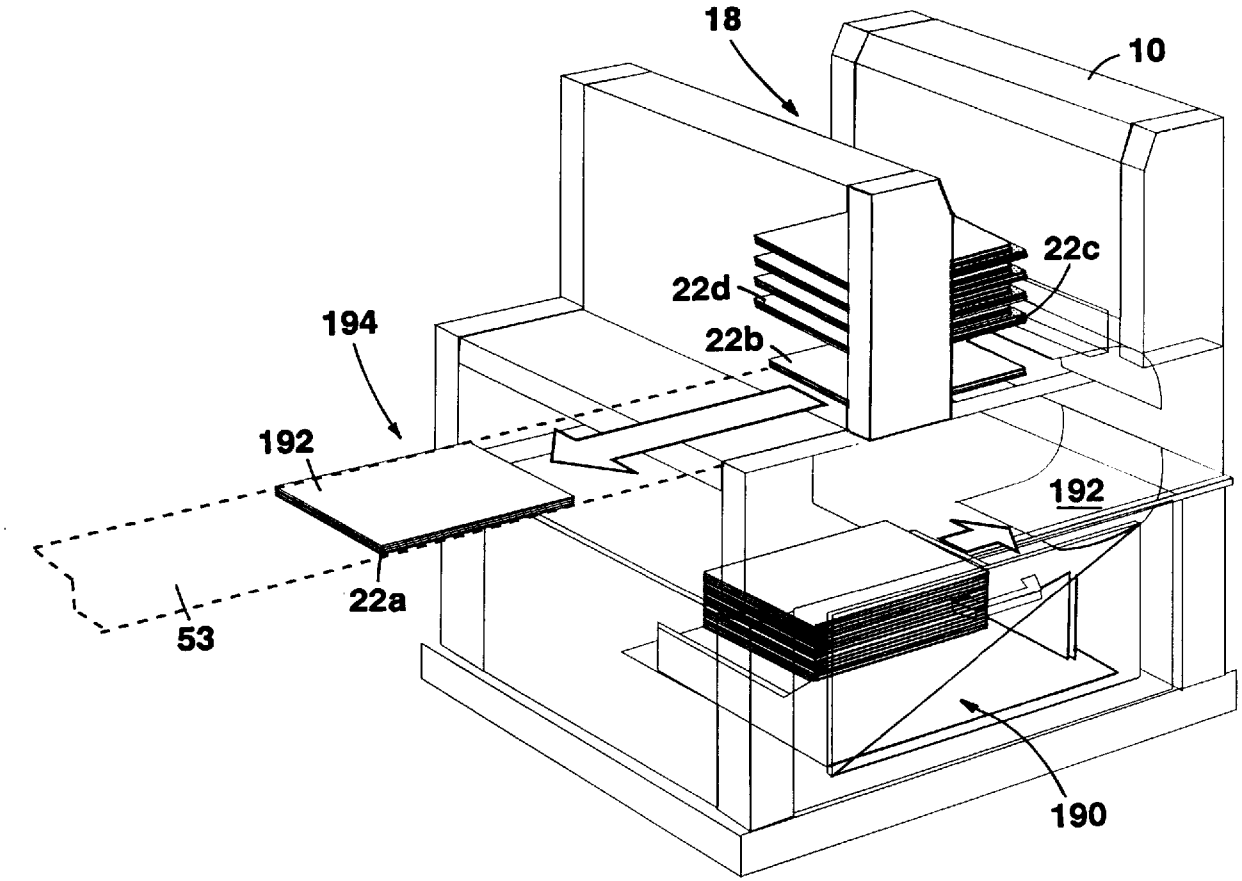
FIG. 9 is a perspective view of the sheet set feeder shown in FIG. 1 mated to a cover feeder.
Figure 10:
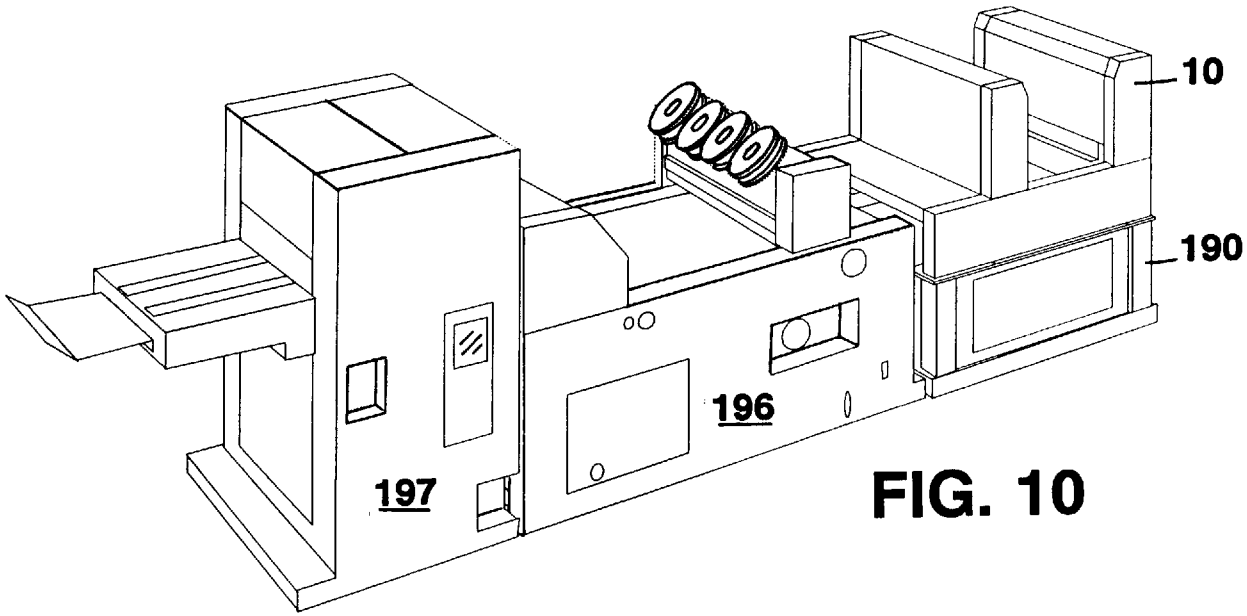
FIG. 10 is a perspective view of the sheet set feeder/cover feeder assembly shown in FIG. 9 mated to a stitcher/folder and a face trimmer.
Figure 11:
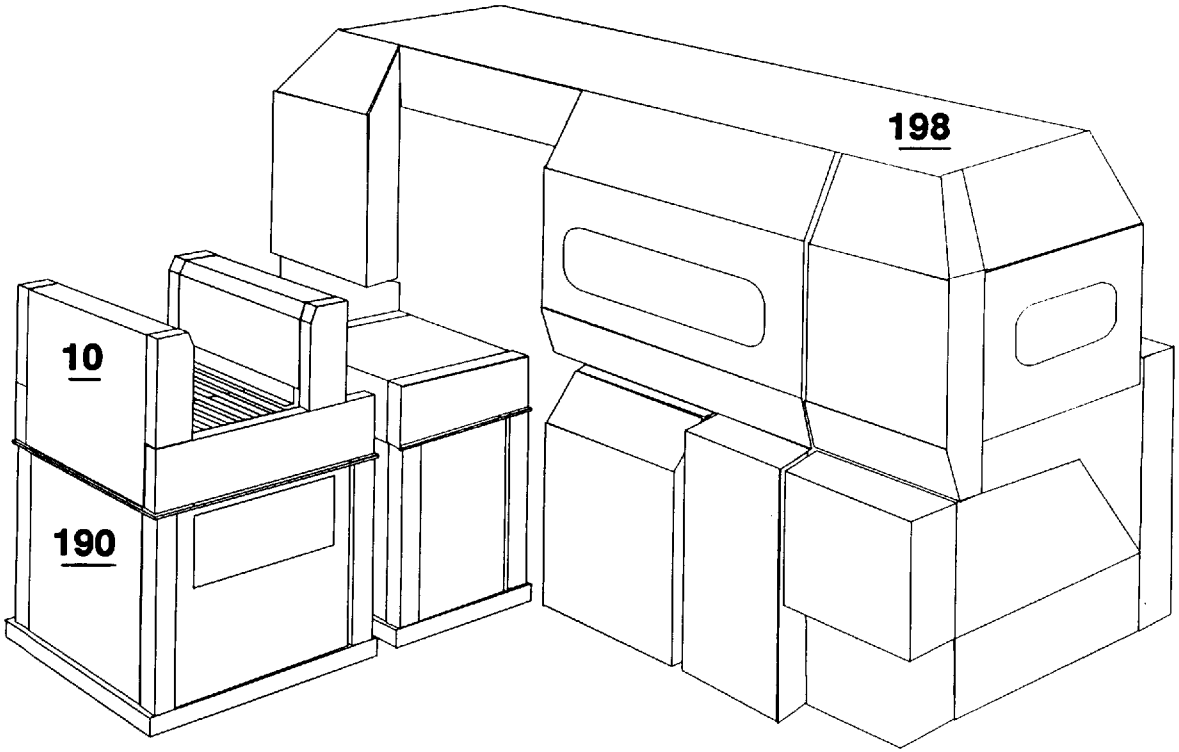
FIG. 11 is a perspective view of the sheet set feeder/cover feeder assembly shown in FIG. 9 mated to a perfect binder.
Figure 12:
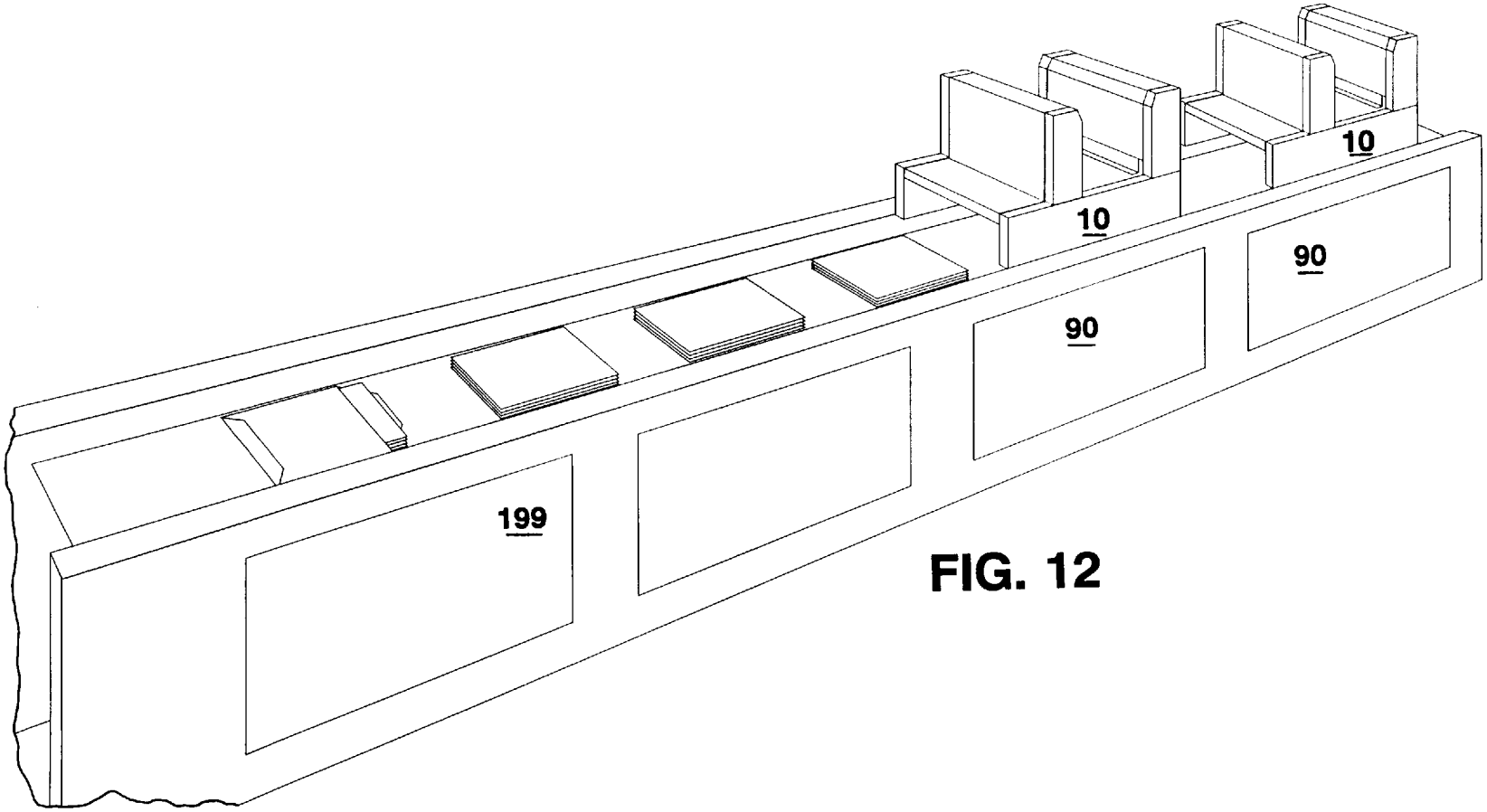
FIG. 12 is a perspective view of two of the sheet set feeder/cover feeder assemblies shown in FIG. 9 mated in tandem to a mailing/inserting system.
Figure 13:
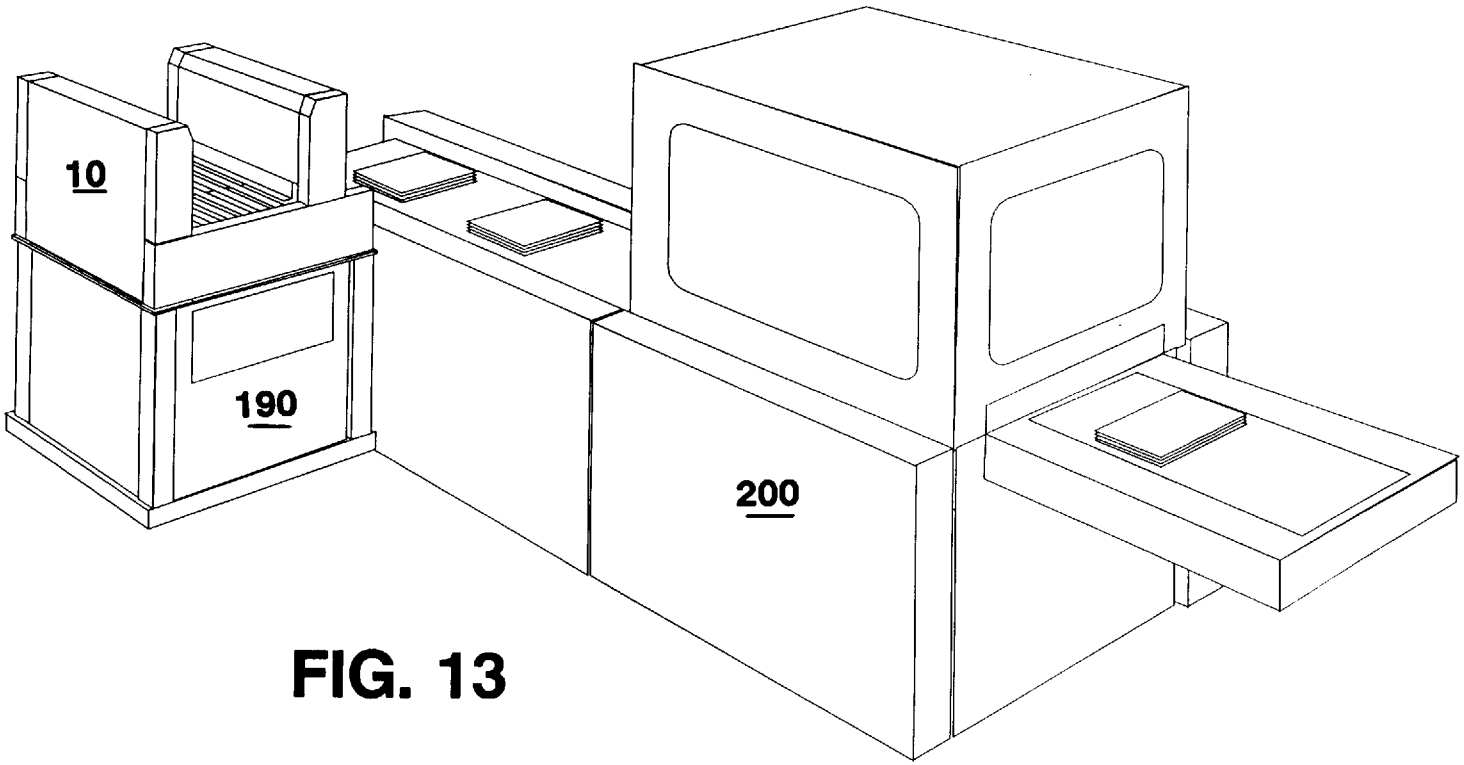
FIG. 13 is a perspective view of the sheet set feeder/cover feeder assembly shown in FIG. 9 mated to a shrink wrapper.

Set feeder 10 thus allows individual sheet sets to be removed from the bottom of an offset-jogged stack of such sets. As shown in FIG. 9, set feeder 10 or 110 may be mated with a cover feeder 190, which typically feeds one or more covers 192 for each sheet set 22*a*, 22*b*, 22*c*, 22*d* fed by feeder 10. After the cover is placed on the top (and/or bottom) of the sheet set, the complete document 194 may then be sent (using conveyor belt 53, shown in phantom in FIG. 9) for further processing, e.g., by a stitcher/folder 196 (e.g., a Standard Horizon SPF-10 or SPF-20, available from Standard Duplicating Machines Corporation, 10 Connector Road, Andover, Mass.) and/or a face trimmer 197 (e.g., a Standard Horizon FC-10), as shown in FIG. 10. Alternatively or additionally, the document may be processed by a perfect binder 198 (FIG. 11, e.g. a Standard Horizon BQ-440), a mailing/inserting system 199 (FIG. 12, e.g., a Gunther DP 100), and/or a shrink wrapper 200 (FIG. 13, e.g., a Schaffer unit).

Each offset-jogged sheet set in the stack placed into the hoppers of sheet set feeders 10, 110 is often a entire document, and each set is fed directly to one or more of the above processors or finishers after it is stripped off the bottom of the stack by the feeder. In some instances, however, particularly in the case of lengthy documents, each set is only a portion of a document, and it is necessary to combine multiple sets or add additional pages to a set to make a complete document prior to processing.

Figure 14:
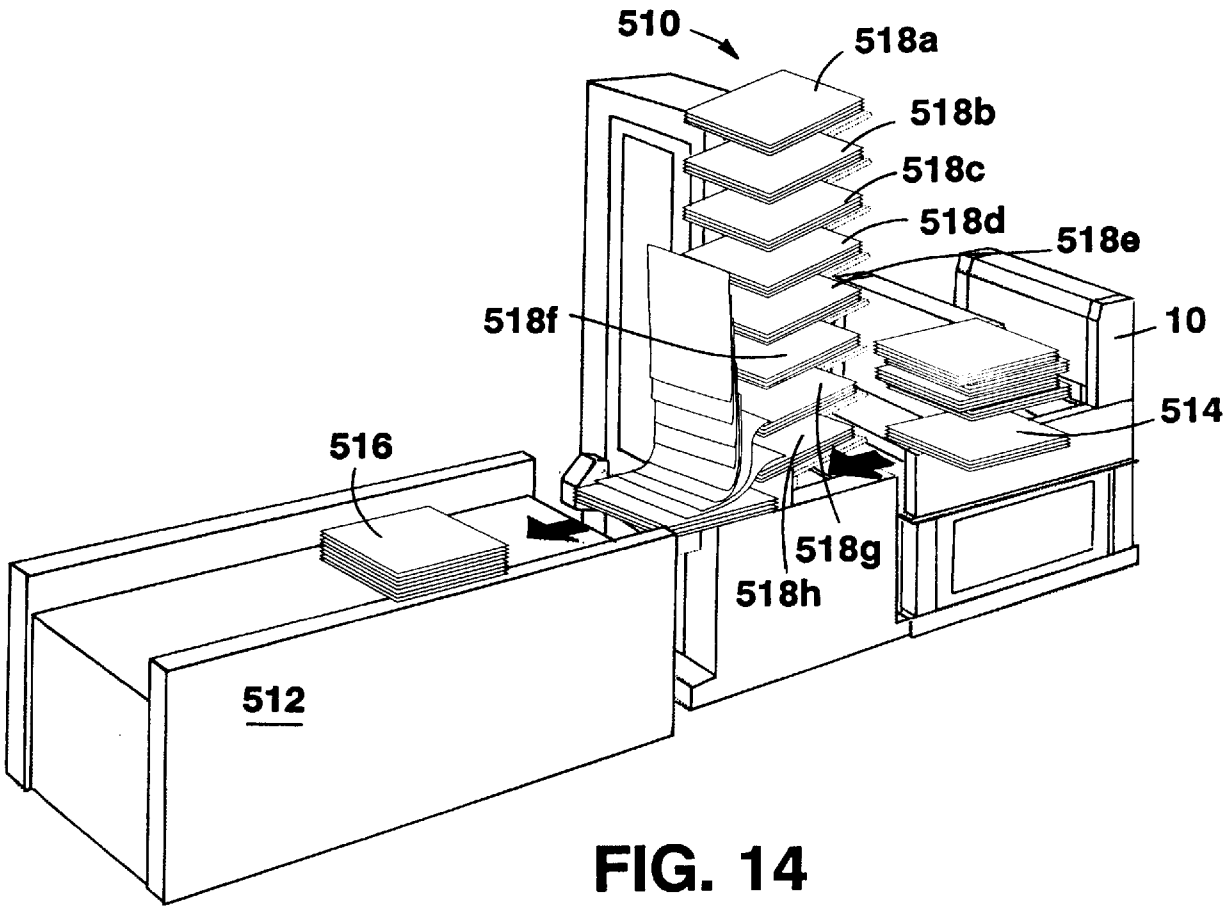
FIG. 14 is a perspective view of the sheet set feeder/cover feeder assembly shown in FIG. 9 mated to a collator and finisher.
Figure 15:
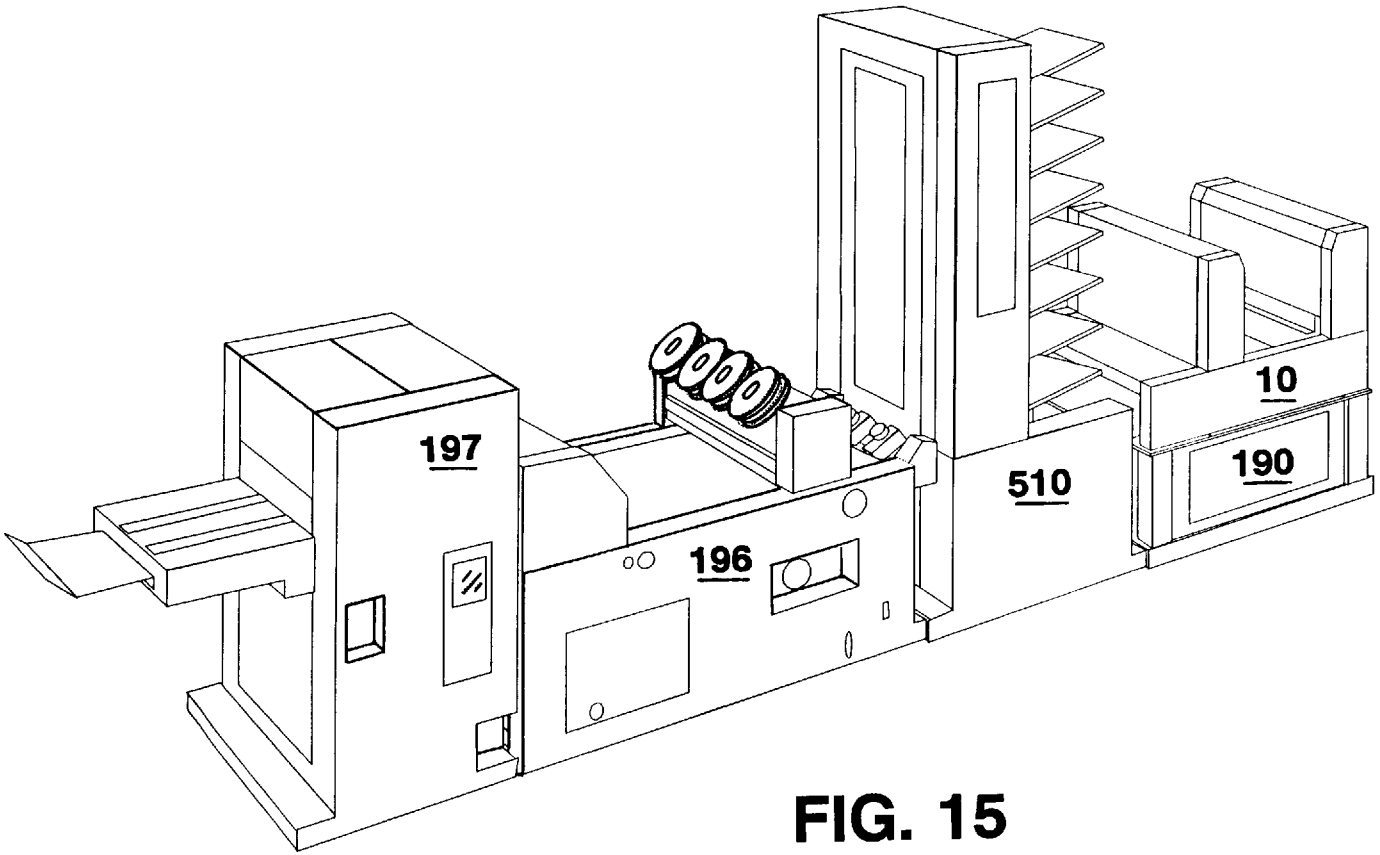
FIG. 15 is a perspective view of the sheet set feeder/cover feeder assembly shown in FIG. 9 mated to a collator, a stitcher/folder, and a face trimmer.

For example, as shown in FIG. 14, sheet set feeder 10 is mated to, e.g., a Horizon MC-80 collator 510 and a finisher 512 (finisher 512, shown schematically in FIG. 14, generically represents one or more of the above-described processors). Each of the individual sets 514 loaded into feeder 10 is only a portion of a document 516. The remaining eight pages of document 516 are loaded into the respective bins 518*a*–*h* of collator 510. As set 514 passes through collator 510, a single sheet is drawn from each bin 518*a*–*h* and placed onto set 514 in the proper order to complete document 516. The output of collator 510 is then sent to finisher 512 for further processing, such as by stitcher/folder 196 and face trimmer 197 as shown in FIG. 15.

Figure 16:
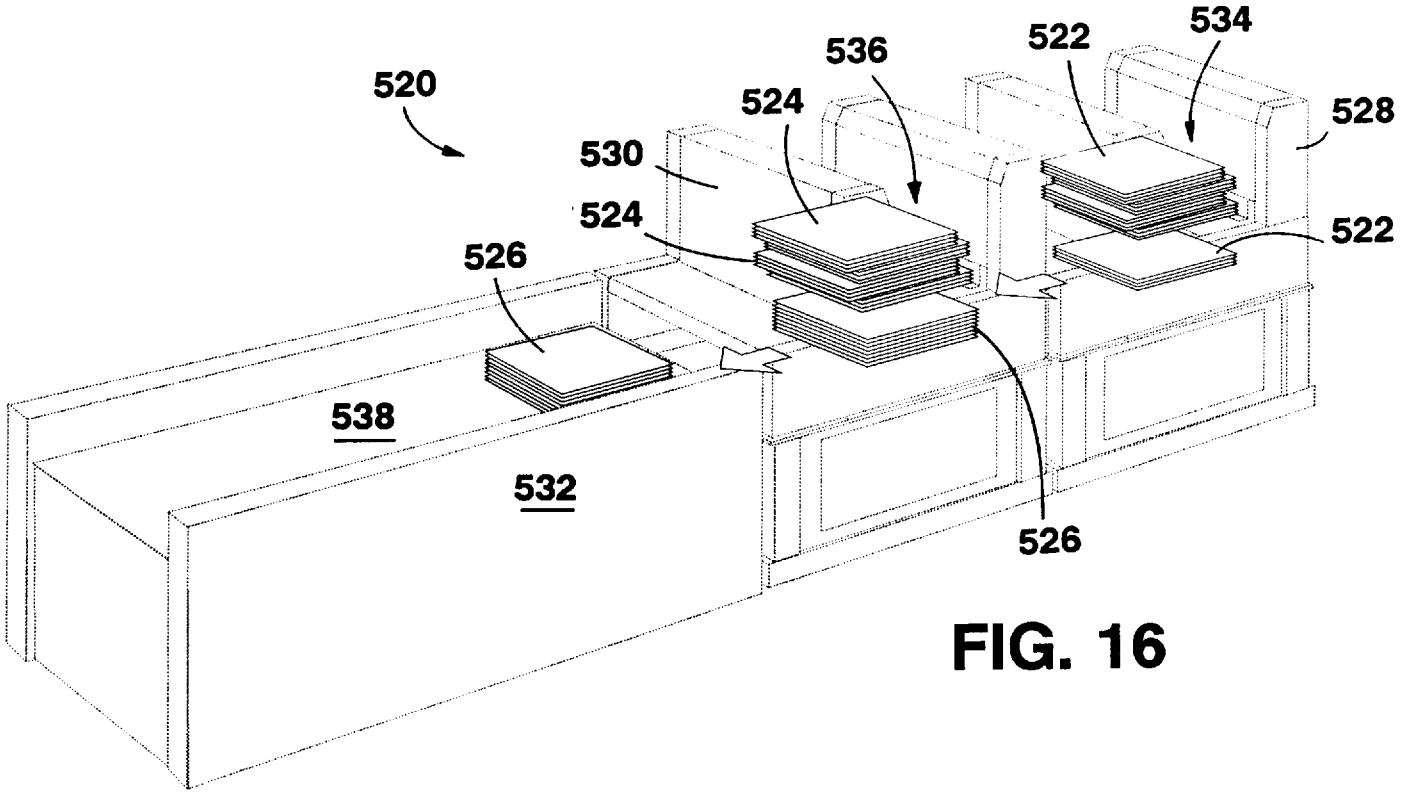
FIG. 16 is a perspective view of two of the sheet set feeder/cover feeder assemblies shown in FIG. 9 mated in tandem to a finisher.

An alternative system 520 for combining sheet sets 522, 524 to make a single document 526 is shown in FIG. 16. In this system, two feeders 528, 530, each similar in construction to either feeder 10 or feeder 110, are connected in tandem, and the output of the second feeder 530 is supplied to a finisher 532. A stack 534 comprising sheet sets 522 is placed into feeder 528, and a stack 536 comprising sheet sets 524 is placed into feeder 530. Feeder 528 strips sheet set 522 off the bottom of stack 534 and sends it, via a conveyor 538, to feeder 530. As set 522 passes through feeder 530, set 524 is stripped off the bottom of stack 536 and placed on top of set 522 to complete document 526, which is then finished or processed as desired.

Figure 17:
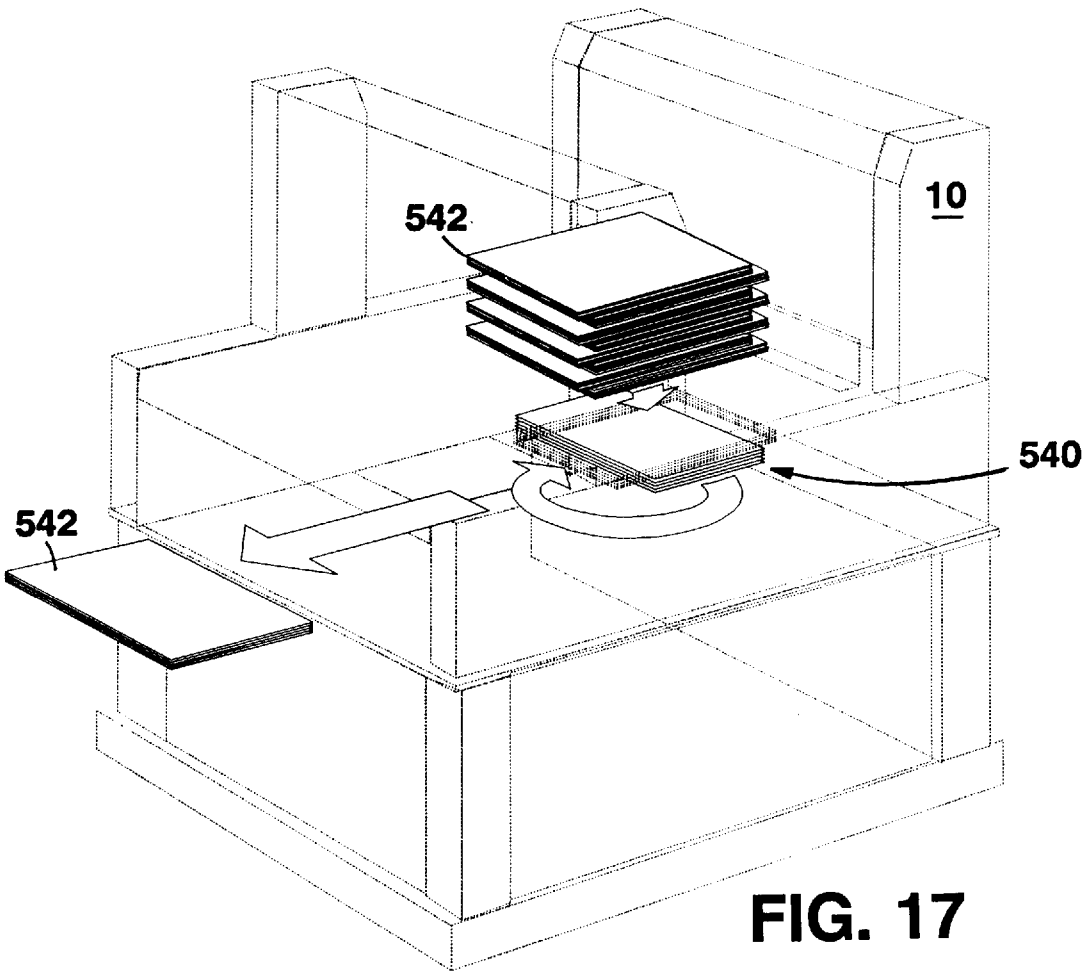
FIG. 17 is a perspective view of the sheet set feeder/cover feeder assembly shown in FIG. 9 with a rotator for rotating sheet sets.

In certain processing or finishing equipment, it is preferable that the set to be processed enter the processor "long-edge" first. However, because of the configuration of feeder 10 (as well as of feeder 110), sets 22*a*, 22*b*, 22*c*, 22*d* absent some additional manipulation enter the processors "short-edge" first. To reorient the sets to accommodate such processing equipment, feeders 10, 110 can optionally be provided with a rotator 540 that rotates individual sets 542, e.g., by 90°, as shown in FIG. 17.

Figure 18:
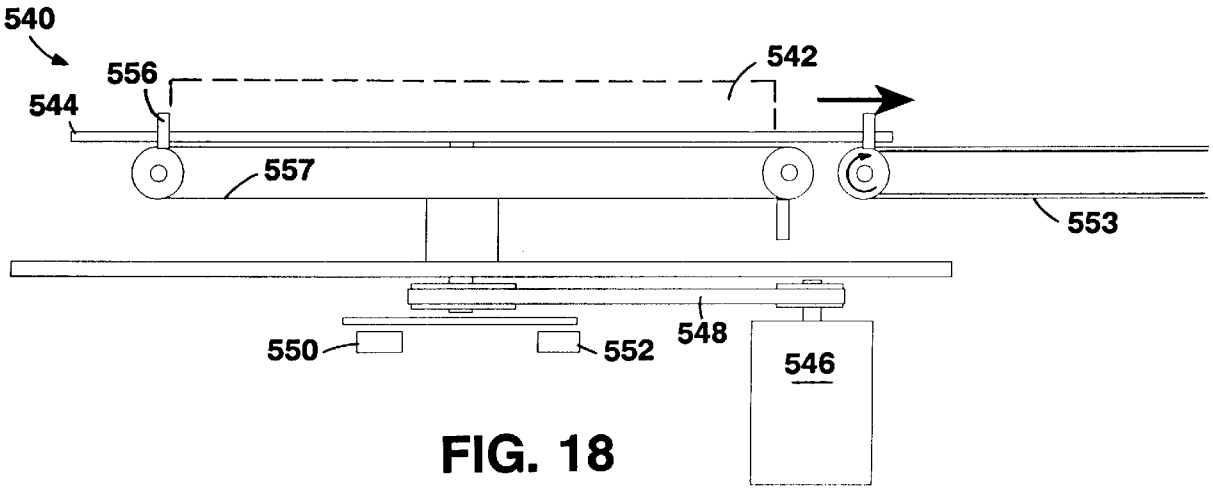
FIG. 18 is a side view of the rotator of the assembly shown in FIG. 17.
Figure 19:
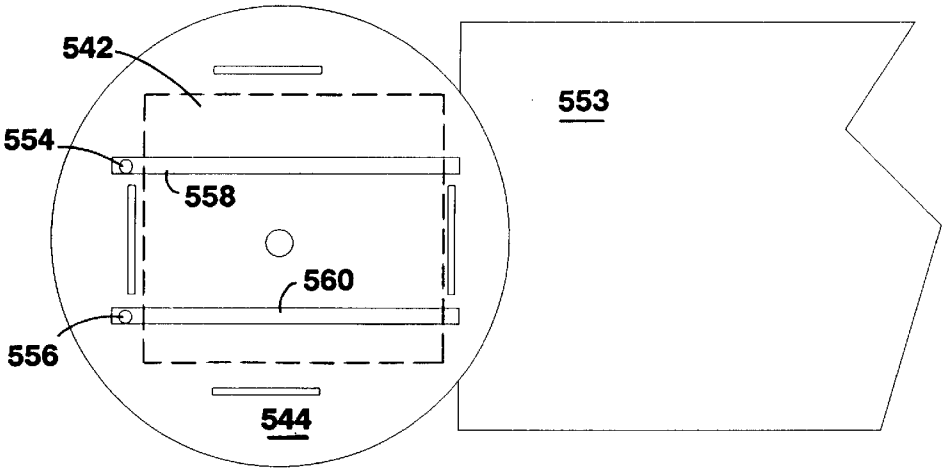
FIG. 19 is a top view of the rotator of the assembly shown in FIG. 17.

The details of rotator 540 are shown in FIGS. 18 and 19. Rotator 540 includes a platter 544 disposed directly beneath door 44 (FIG. 1) of feeder 10. After a set 542 (shown in phantom) falls onto platter 544, the platter is rotated by a motor 546 and drive belt 548 assembly until set 542 is oriented as desired, as indicated by sensors 550, 552 that sense the rotational position of platter 544. Set 542 is then pushed off platter 544 and onto a main conveyor belt 553 by pusher pins 554, 556 that are driven by a secondary conveyor belt 557 so as to travel along slots 558, 560 in platter 544. Main conveyor belt 553 then, e.g., delivers set 545 to a finisher or processor.

The specific implementation set forth above is only one illustration of an embodiment of the invention. Other embodiments are within the claims.

Figure 20:
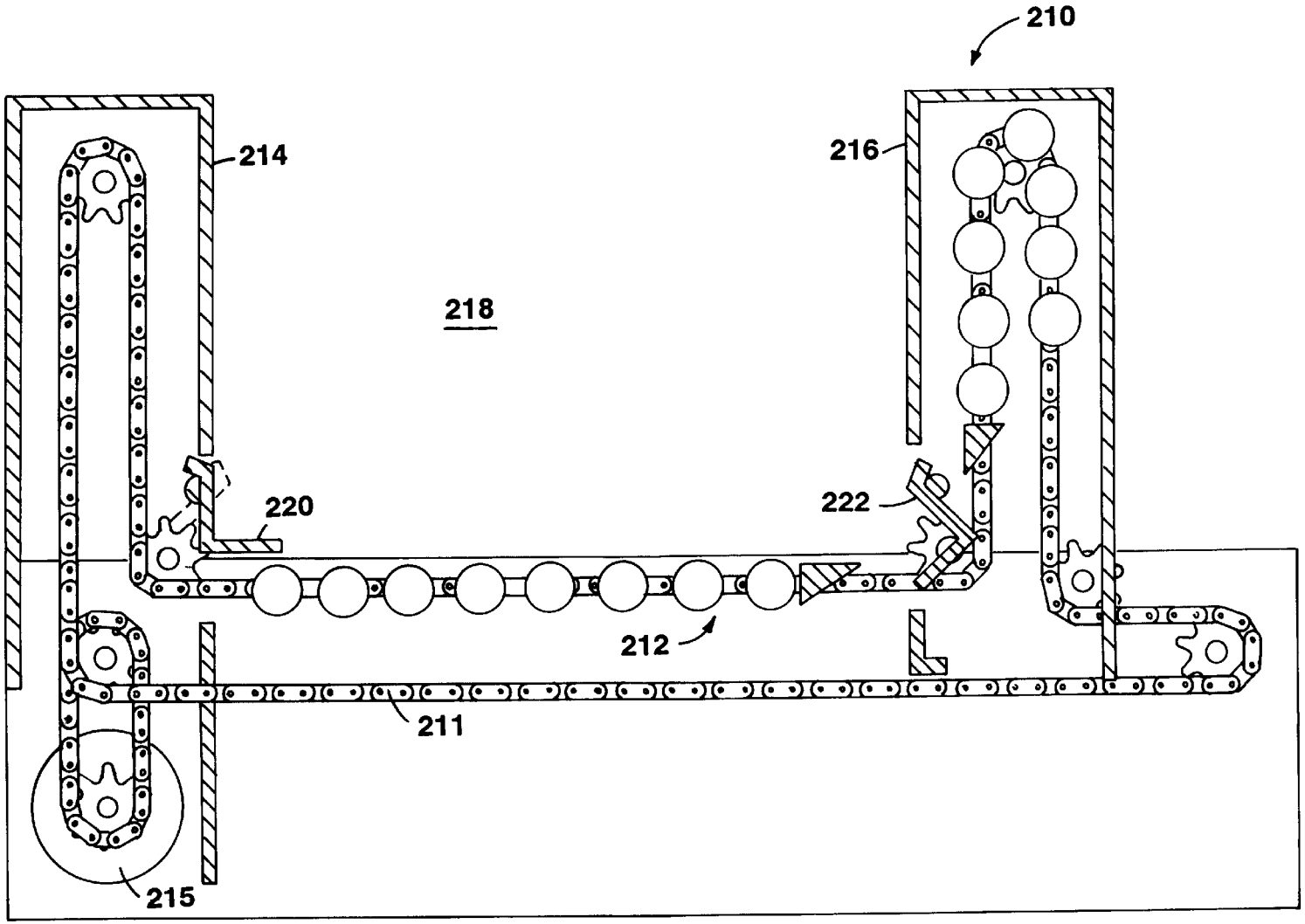
FIG. 20 is a cross-sectional side view of another sheet set feeder.
Figure 21:
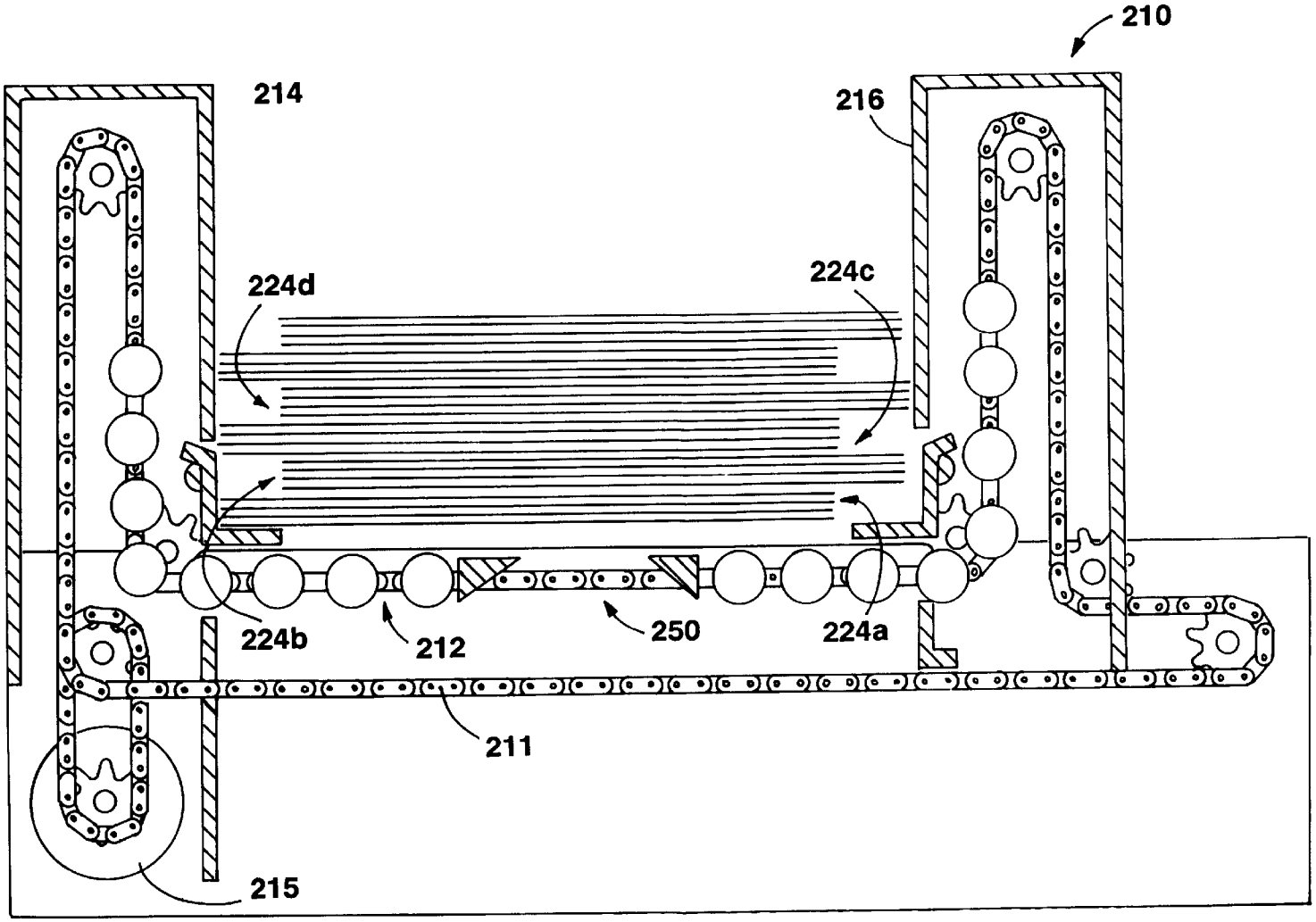
FIG. 21 is a cross-sectional side view of the sheet set feeder shown in FIG. 20, with a stack of sheet sets placed into the feeder.
Figure 22:
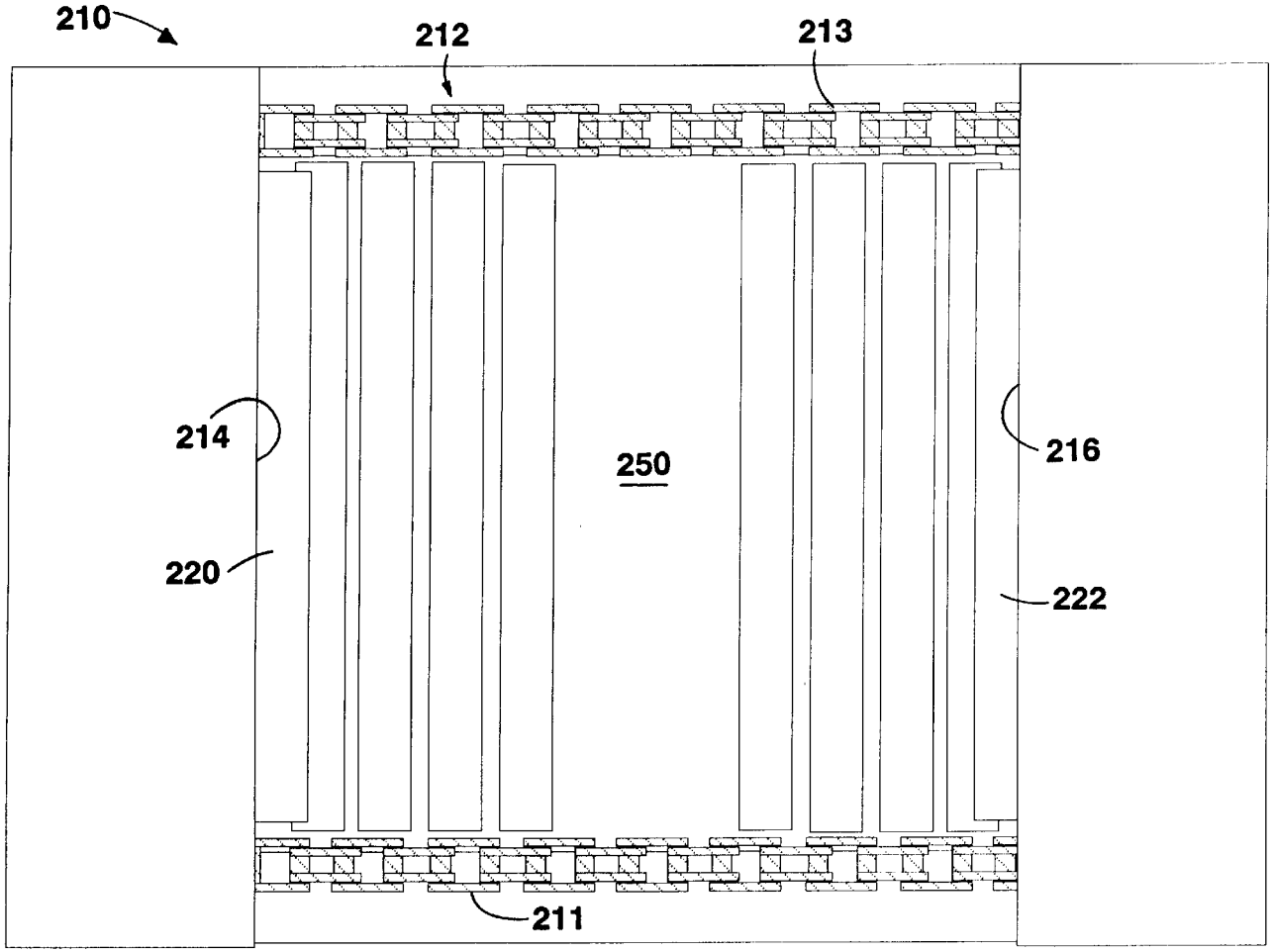
FIG. 22 is a top view of the sheet set feeder shown in FIG. 20.

For example, because it is flexible, the shutter of the paper set feeder need not run around an oval path as in feeders 10, 110, but can instead circulate through a variety of configurations to conform to packaging or other constraints. Thus, as shown in FIGS. 20, 21, and 22, a paper set feeder 210 can have a flexible shutter 212 (comprising chains 211, 213 driven by a reversible motor 215) that is routed behind the left and right walls 214, 216 of a hopper 218. As with feeders 10 and 110, left and right shelves 220, 222 support the ends of alternate sets 224*a*, 224*b*, 224*c*, 224*c* stacked in hopper 218.

Figure 23:
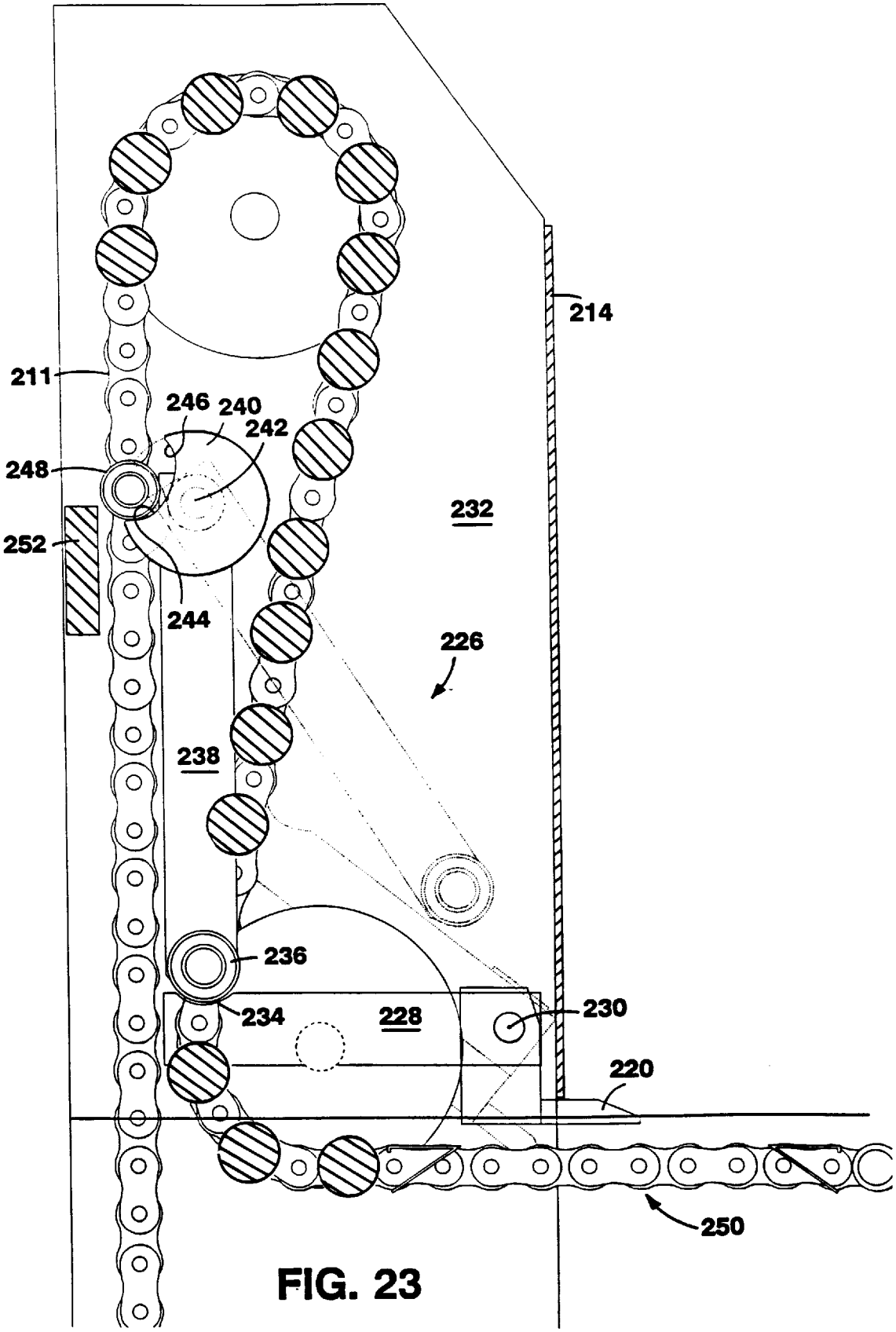
FIG. 23 is a cross-sectional side view of a mechanism for actuating a shelf of the sheet set feeder shown in FIG. 20.
Figure 24A:
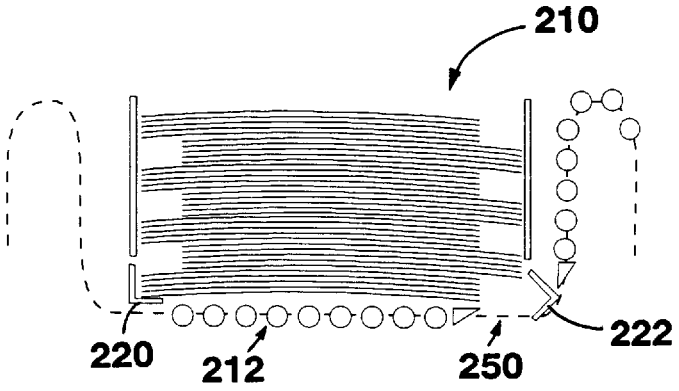
FIGS. 24A, 24B, 24C, and 24D are schematic side views showing the sheet set feeder shown in FIG. 20 in operation.
Figure 24B:
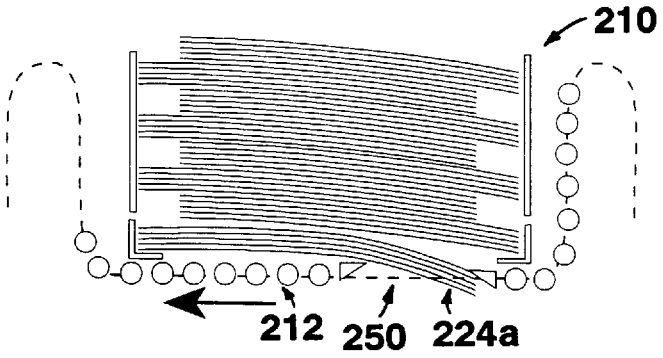
Figure 24C:
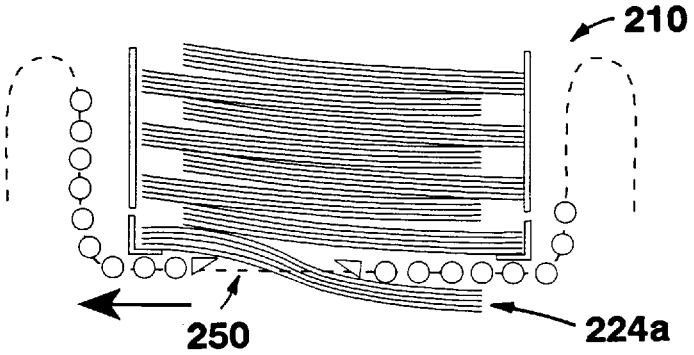
Figure 24D:
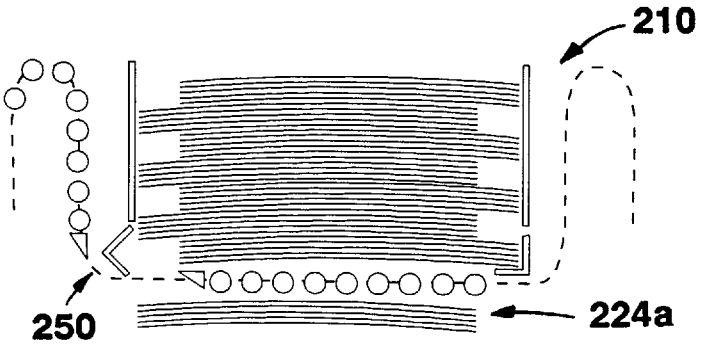

The mechanism 226 for actuating the left shelf 220 of feeder 210 is shown in detail in FIG. 23. The mechanism for actuating right shelf 222 is identical in all material respects to mechanism 226. Left shelf 220 is attached to the right end of a pivot arm 228 pivotally attached by a pin hinge/torsion spring 230 to the housing 232 of feeder 210. A recess 234 in the left end of pivot arm 228 receives the outer race of a bearing 236 attached to one end of an actuating arm 238, such that pin hinge/torsional spring 230 biases pivot arm 228 in a clockwise direction against bearing 236. The other end of actuating arm 238 is attached to a cam 240 pivotally attached by a pin hinge 242 to housing 232. Cam 240 defines a pair of superimposed crescent-shaped recesses 244, 246 in its outer circumference. Recesses 244, 246 are sized to receive the outer race of a bearing 248 attached to link chain 211.

When link chain 211 moves bearing,248 down past cam 240 (i.e., when the aperture 250 defined by shutter 212 moves past left wall 214), it engages recess 244, rotating cam 240 and actuating arm 238 in a counter-clockwise direction, to the position shown in phantom in FIG. 23. Because pivot arm 228 is no longer restrained from rotating by bearing 236, pin hinge/torsional spring 230 rotates it in a clockwise direction, to the position shown in phantom in FIG. 23, causing left shelf 220 to drop down. As bearing 248 continues to move down, it passes a proximity switch 252 mounted to housing 232, which reverses the direction of rotation of motor 215, and thus also the direction of movement of chains 211, 213 and aperture 250.

When link chain 211 moves bearing 248 back up past cam 240, it engages recess 246, rotating cam 240 and actuating arm 238 in a clockwise direction back to its original vertical position. As actuating arm 238 rotates, bearing 236 engages the top surface of pivot arm 228, rotating it and left shelf 220 in a counter-clockwise direction back to their original horizontal positions.

The operation of paper set feeder 210 is illustrated in FIGS. 24A, 24B, 24C, and 24D, and is similar in material respects to the operation of set feeders 10 and 110.

Figure 25A:
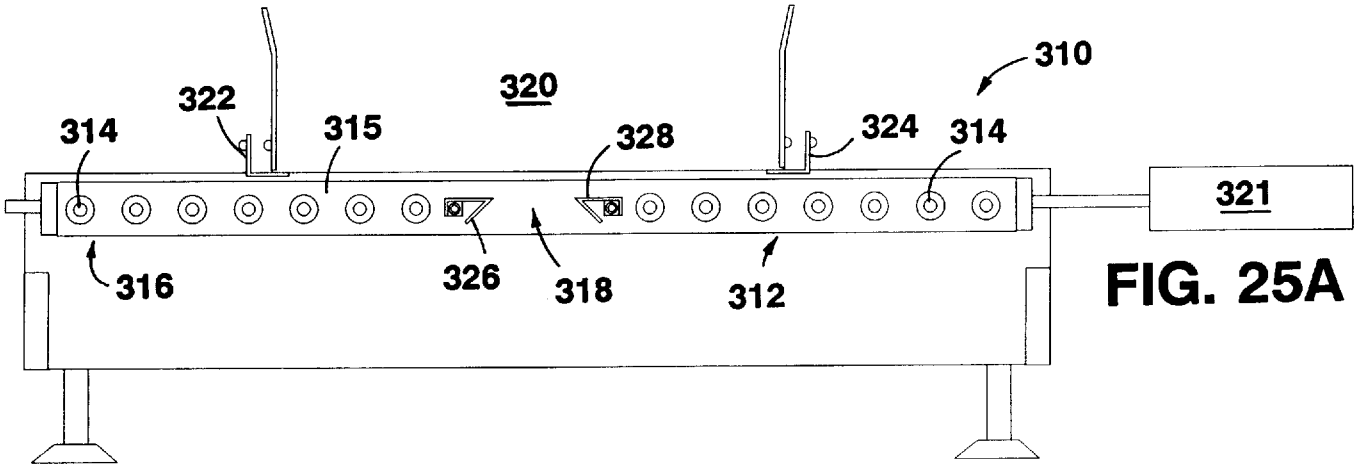
FIGS. 25A and 25B are side views of another sheet set feeder.
Figure 25B:
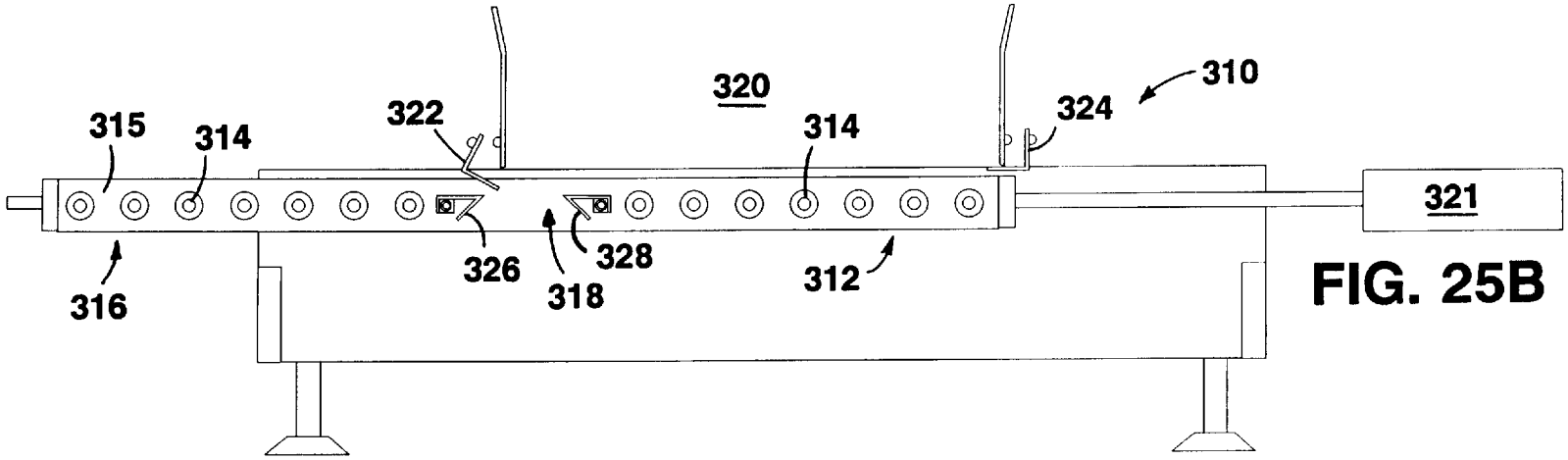
Figures 26A, 26B, 26C, 26D:
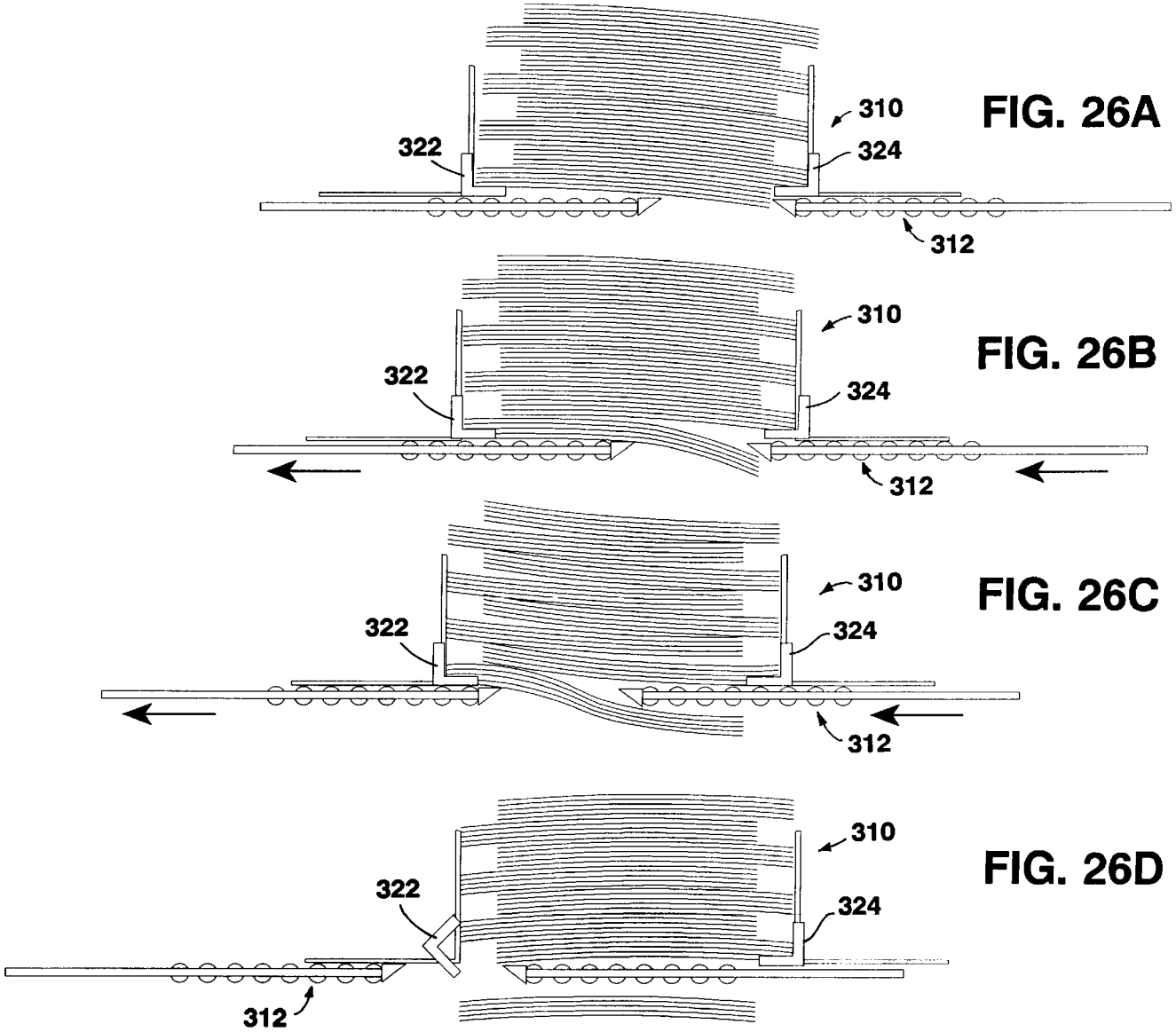
FIGS. 26A, 26B, 26C, and 26D are schematic side views showing the sheet set feeder shown in FIGS. 25A and 25B in operation.

Although making shutters 26, 120, 212 flexible so they can, e.g., wrap around the sides of hopper 218 (as in the case of feeder 210) or into other non-planar configurations may make feeders 10, 110, 210 more compact, the shutter can instead be relatively rigid and planar. For instance, as shown in FIGS. 25A and 25B, a set feeder 310 includes a shutter 312 comprised of individual rollers 314 disposed between the sides 315 (only one side shown) of a rectangular frame 316, e.g., of metal. As frame 316, and thus also the aperture 318 defined by shutter 312, shuttles back and forth with respect to the hopper 320, rollers 314 remain essentially coplanar. Frame 316 is shuttled back and forth by a pneumatic cylinder 321, but could instead be driven, e.g., manually, by a hydraulic cylinder, or by a drive chain arrangement similar to those employed in set feeders 10, 110, 210.

Like set feeder 10, set feeder 310 includes left and right shelves 322, 324 and left and right wedges 326, 328 at the edges of aperture 318. Shelves 322, 324 can be actuated using any of the above-described mechanisms, or can instead be actuated by any other suitable mechanism, such as individual solenoids that are controlled based on the output of a sensor or sensors that determine the position of the aperture with respect to the hopper. In operation, set feeder 310 behaves in much the same manner as set feeders 10, 110, and 210 as shown in FIGS. 26A, 26B, 26C, and 26D.

Although used in feeders 10, 110, 210, 310, the sheet set feeder need not have separate and discrete right and left shelves that support the edges of the bottommost and next-to-bottommost sheet sets. Such a feeder 410 is shown in operation in FIGS. 27A, 27B, 27C, 27D, 27E. (Although feeder 410 does not include right and left wedges at the edges of the aperture 412 in its shutter 414, they could be included if desired.)

Shutter 414 of feeder 410 is relatively rigid and planar, like shutter 312 of feeder 310, but could instead be flexible if desired. Whereas the lengths of the apertures in set feeders 10, 110, 210, 310 remain fixed during operation, the length of aperture 412 varies as shutter 414 shuttles back and forth. As described below, this is accomplished by using two separate drive systems 432, 434 (shown schematically in FIG. 27A) that independently control, based on the outputs of a series of proximity sensors 436, 437, 438, 439, 440, 441, 442, 443 located to sense the position of shutter 414, the movement of the left and right halves 444, 446 of shutter 414. Drive systems 432, 434 comprise reversible motor and drive chain arrangements similar to those employed in set feeders 10, 110, 210, but could instead comprise, e.g., pneumatic or hydraulic cylinders as in set feeder 310.

Figure 27A:
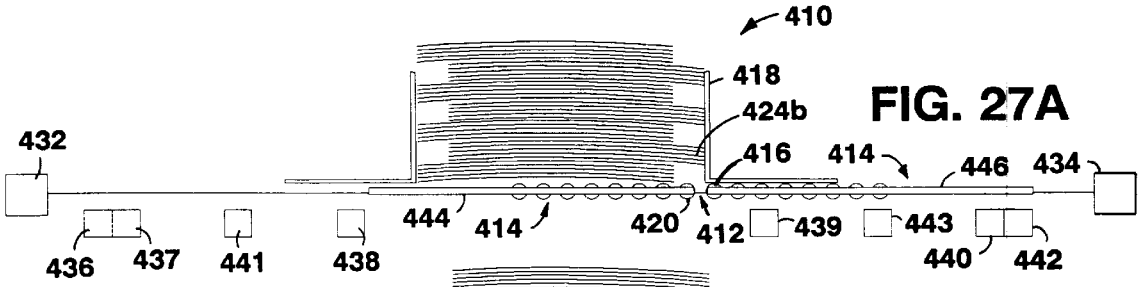
FIGS. 27A, 27B, 27C, 27D, and 27E are schematic side views showing another sheet set feeder in operation.
Figure 27B:
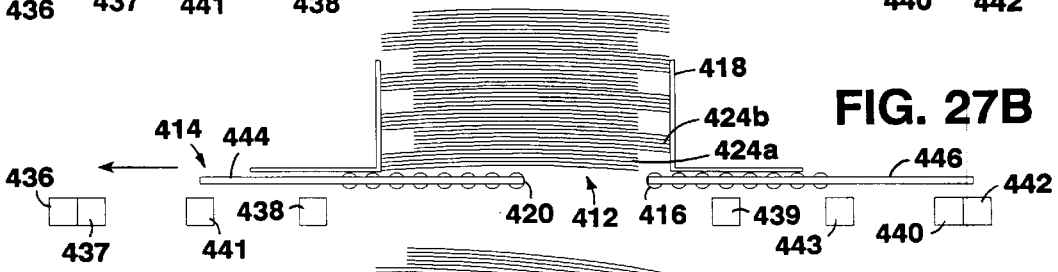
Figure 27C:
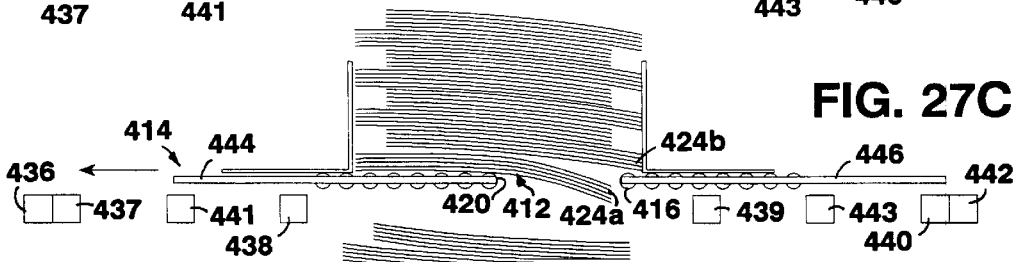
Figure 27D:
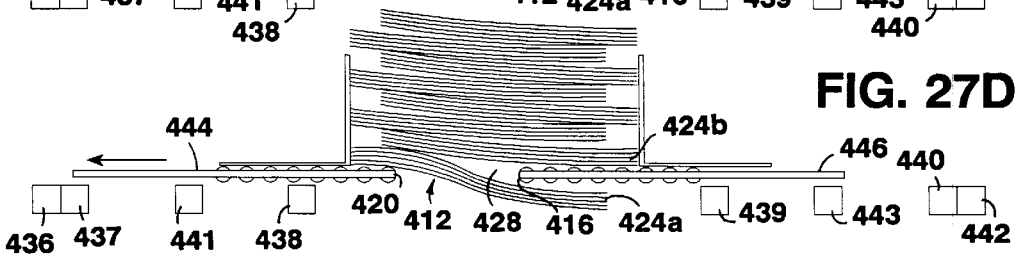
Figure 27E:
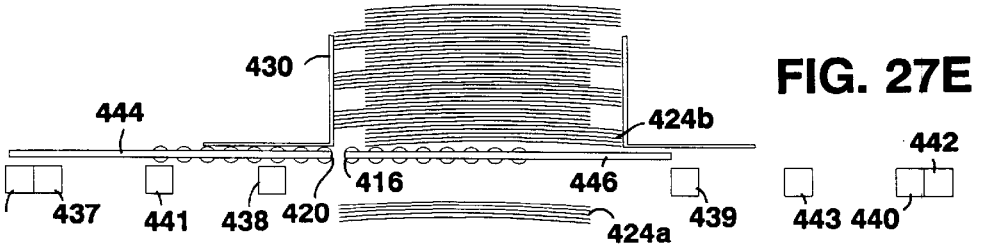

As shown in FIG. 27A, when the right edge 416 of aperture 412 is even with the right wall 418 of feeder 410 (as indicated by sensor 442), the left edge 420 of aperture 412 is immediately adjacent right edge 416 (as indicated by sensor 438). At this point, both halves 444, 446 of shutter 414 are moved so that both right edge 416 and left edge 420 move together to the left. When right edge 416 is even with the right edge of the bottommost set 424*a* in the stack 426 (as indicated by sensor 440), as shown in FIG. 27B, right half 446 stops moving, and left half 444 continues to move to the left. As the length of aperture 412 increases, the right end of bottommost set 424*a* droops through the aperture, as shown in FIG. 27C. The portion of shutter 414 disposed immediately adjacent right edge 416 of aperture 412 supports next-to-bottommost set 424*b*, preventing it from also drooping through the aperture. When the length of aperture 412 has increased sufficiently (as indicated by sensor 441), such that a gap 428 has formed between bottommost set 424*a* and next-to-bottommost set 424*b*, right half 446 of shutter 414 resumes moving to the left, at the same speed as left half 444. Right edge 416 then enters gap 428, stripping bottommost set 424*a* off the bottom of stack 426 as shown in FIG. 27D. When left edge 420 of aperture 412 reaches the left wall 430 of feeder 410 (as indicated by sensor 436), left half 444 of shutter 414 stops moving. Right half 446 continues to move to the left until it is immediately adjacent left edge 420 (as indicated by sensor 439), as shown in FIG. 27E. The process then reverses to strip off next-to-bottommost set 424*b*.

The various features of the embodiments described herein, such as the air jet passages, the primary and secondary accumulator arrangement, the tensioning bar, the shelf-actuation mechanisms, and the drive mechanisms, may be interchanged among the various sheet set feeders as desired.

What is claimed is:

1. An apparatus comprising:

an offset-jogged stack of sheet sets comprising a first sheet set and a second sheet set disposed immediately adjacent said first sheet set, said first and second sheet sets each consisting essentially of a homogenous plurality of rectangular sheets and each having opposed first and second ends, said first and second ends of said first sheet set being offset-jogged relative to said respective first and second ends of said second sheet set;

an offset-jogged sheet set feeder containing said offset-jogged stack of sheet sets, said offset-jogged sheet feeder being operable to sequentially provide in series at an output said first sheet set and said second sheet set;

a sheet set processor for processing sheet sets; and a sheet set conveyor disposed to mechanically convey sheet sets from said offset-jogged sheet set feeder to said sheet set processor.

2. A sheet set processing system as recited in claim 1 wherein said sheet set conveyor comprises a sheet set rotator.

3. A sheet set processing system as recited in claim 1 wherein said offset-jogged sheet set feeder comprises a shutter defining an aperture sized to admit said first sheet set and said second sheet set.

4. A sheet set processing system as recited in claim 3 wherein said offset-jogged sheet set feeder comprises a driver for moving said shutter from a first position wherein said aperture is disposed beneath said first end of said first sheet set to a second position wherein said aperture is disposed beneath said second end of said first sheet set.

5. A sheet set processing system as recited in claim 1 further comprising a cover feeder.

6. A sheet set processing system as recited in claim 1 wherein said sheet set processor comprises a stitcher.

7. A sheet set processing system as recited in claim 1 wherein said sheet set processor comprises a folder.

8. A sheet set processing system as recited in claim 1 wherein said sheet set processor comprises a face trimmer.

9. A sheet set processing system as recited in claim 1 wherein said sheet set processor comprises a perfect binder.

10. A sheet set processing system as recited in claim 1 wherein said sheet set processor comprises a mailing/inserting system.

11. A sheet set processing system as recited in claim 1 wherein said sheet set processor comprises a shrink wrapper.

12. A sheet set processing system as recited in claim 1 wherein said sheet set processor comprises a collator.

13. A sheet set processing system as recited in claim 1 wherein said first sheet set is said bottommost sheet set of said stack of sheet sets.

14. A sheet set processing system as recited in claim 13 wherein said second sheet set is said next-to-bottommost sheet set of said stack of sheet sets.

15. A sheet set processing system as recited in claim 1 wherein said first sheet set is below said second sheet set in said stack of sheet sets.

16. A sheet set processing system as recited in claim 1 wherein at least some of said rectangular paper sheets in said first and second sheet sets bear printed indicia.

17. A sheet set processing method comprising:

providing an offset-jogged sheet set feeder;

loading the offset-jogged sheet set feeder with a stack of sheet sets comprising a first sheet set having opposed first and second ends and a second sheet set having opposed first and second ends, the first and second ends of the first sheet set being offset-jogged relative to the respective first and second ends of the second sheet set;

operating the offset-jogged sheet set feeder to sequentially provide in series at an output the first sheet set and the second sheet set;

mechanically conveying the first sheet set and the second sheet set in sequence from the output of the offset-jogged sheet set feeder to a sheet set processor;

processing the first sheet set and the second sheet set in sequence in the sheet set processor.

18. A sheet set processing method as recited in claim 17 wherein the first sheet set is the bottommost sheet set of the stack of sheet sets.

19. A sheet set processing method as recited in claim 18 wherein the second sheet set is the next-to-bottommost sheet set of the stack of sheet sets.

20. A sheet set processing method as recited in claim 17 wherein the first sheet set is below the second sheet set in the stack of sheet sets.

21. A sheet set processing method as recited in claim 17 wherein the first sheet set is disposed immediately adjacent the second sheet set.

22. A sheet set processing method as recited in claim 17 wherein the first and second sheet sets each comprises a plurality of paper sheets.

23. A sheet set processing system as recited in claim 22 wherein at least some of the paper sheets in the first and second sheet sets bear printed indicia.

24. A sheet set processing method as recited in claim 22 wherein the first and second sheet sets each consists essentially of a plurality of paper sheets.

25. A sheet set processing method as recited in claim 24 wherein the first and second sheet sets each consists essentially of a plurality of rectangular paper sheets.

26. A sheet set processing method comprising:

providing an offset-jogged sheet set feeder;

loading the offset-jogged sheet set feeder with a stack of sheet sets comprising a bottommost sheet set having opposed first and second ends and a next-to-bottommost sheet set having opposed first and second ends, the first and second ends of the bottommost sheet set being offset-jogged relative to the respective first and second ends of the next-to-bottommost sheet set;

operating the offset-jogged sheet set feeder to sequentially provide in series at an output the bottommost sheet set and the next-to-bottommost sheet set;

mechanically conveying the bottommost sheet set and the next-to-bottommost sheet set in sequence from the output of the offset-jogged sheet set feeder to a sheet set processor;

processing the bottommost sheet set and the next-to-bottommost sheet set in sequence in the sheet set processor.

* * * * *